US009285747B2

(12) United States Patent
Shibuya

(10) Patent No.: US 9,285,747 B2
(45) Date of Patent: Mar. 15, 2016

(54) IMAGE FORMING APPARATUS, CONTROL METHOD, AND STORAGE MEDIUM

(71) Applicant: CANON KABUSHIKI KAISHA, Tokyo (JP)

(72) Inventor: Yuichiro Shibuya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/471,908

(22) Filed: Aug. 28, 2014

(65) Prior Publication Data

US 2015/0063840 A1 Mar. 5, 2015

(30) Foreign Application Priority Data

Aug. 30, 2013 (JP) ..... 2013-179996

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
USPC ..... 399/9, 24, 27–30
See application file for complete search history.

(56) References Cited

U.S. PATENT DOCUMENTS 6,397,017 B1 * 5/2002 Sakai et al. ..... 399/27
7,038,812 B2 * 5/2006 Hashimoto et al. ..... 358/1.9
7,853,160 B2 * 12/2010 Koitabashi ..... 399/24
8,626,017 B2 * 1/2014 Sakatani et al. ..... 399/62

FOREIGN PATENT DOCUMENTS

JP 2006-343621 A 12/2006

* cited by examiner

*Primary Examiner* — Hoan Tran
(74) *Attorney, Agent, or Firm* — Canon USA Inc. IP Division

(57) ABSTRACT

An image forming apparatus includes a dot count unit configured to count a number of dots of print data, a first toner remaining amount value calculation unit configured to, in a case where received print data satisfies a printing condition, calculate a toner remaining amount value for the print data based on the number of dots obtained by the dot count unit, and a second toner remaining amount value calculation unit configured to, in a case where the received print data does not satisfy the printing condition, set a predetermined toner remaining amount value as the toner remaining amount value for the print data.

9 Claims, 25 Drawing Sheets

IMAGE FORMING APPARATUS, CONTROL METHOD, AND STORAGE MEDIUM

BACKGROUND OF THE INVENTION

1. Field of the Invention

The present invention relates to an image forming apparatus, a control method, and a storage medium.

2. Description of the Related Art

Image forming apparatuses are configured to perform image formation on a sheet using a recording material, such as toner. Generally, the recording material is stored in a storage unit, such as a cartridge. Some image forming apparatuses can detect the remaining amount of a recording material remaining in the storage unit and then display the detected value of the remaining amount on a display unit, such as a user interface (UI).

Such a conventional image forming apparatus is equipped with a sensor that detects the remaining amount, and is configured to directly display the value detected by the sensor as the remaining amount of the recording material. Sensors mostly employed in consideration of cost cannot exert correct detection accuracy until the remaining amount reaches a certain low level. In the case of such sensors, the remaining amount of the recording material is detected in a discrete manner, for example, as 100%, 20%, and 0%. As a result, also on the display unit, the remaining amount of the recording material is displayed in a discrete manner, for example, as 100%, 20%, and 0%.

On the other hand, Japanese Patent Application Laid-Open No. 2006-343621 discusses a technique to allow the display unit to display the remaining amount of the recording material in a continuous manner while employing a sensor that discretely detects the remaining amount of the recording material. For example, the technique calculates a predicted value of the toner remaining amount based on a dot count value of raster data during image formation, and displays the calculated predicted value as a current value of the toner remaining amount. Then, when having acquired a sensor value of the toner remaining amount from the sensor, the technique updates the current value with the sensor value.

However, since the dot count function is not a function essential for printing, some image forming apparatuses may have such a hardware configuration that only a typical data path is compatible with the dot count function and other specific data paths are not compatible with the dot count function. Such image forming apparatuses cannot calculate the toner remaining amount value using the dot count function for print data that passes through a data path that is not compatible with the dot count function.

Thus, such image forming apparatuses have no alternative but to abandon calculating the toner remaining amount value for print data that passes through a data path that is not compatible with the dot count function or to calculate a fixed toner remaining amount value for each page without using the dot count function. As a result, the toner remaining amount value calculated using the dot count function may exhibit a transition that greatly deviates from the transition of a physical toner remaining amount value.

SUMMARY OF THE INVENTION

The present invention is directed to an image forming apparatus capable of appropriately displaying a toner remaining amount.

According to an aspect of the present invention, an image forming apparatus includes a dot count unit configured to count a number of dots of print data, a first toner remaining amount value calculation unit configured to, in a case where received print data satisfies a printing condition, calculate a toner remaining amount value for the print data based on the number of dots obtained by the dot count unit, and a second toner remaining amount value calculation unit configured to, in a case where the received print data does not satisfy the printing condition, set a predetermined toner remaining amount value as the toner remaining amount value for the print data.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

(Description of System Configuration of Printer)

Figure 1:
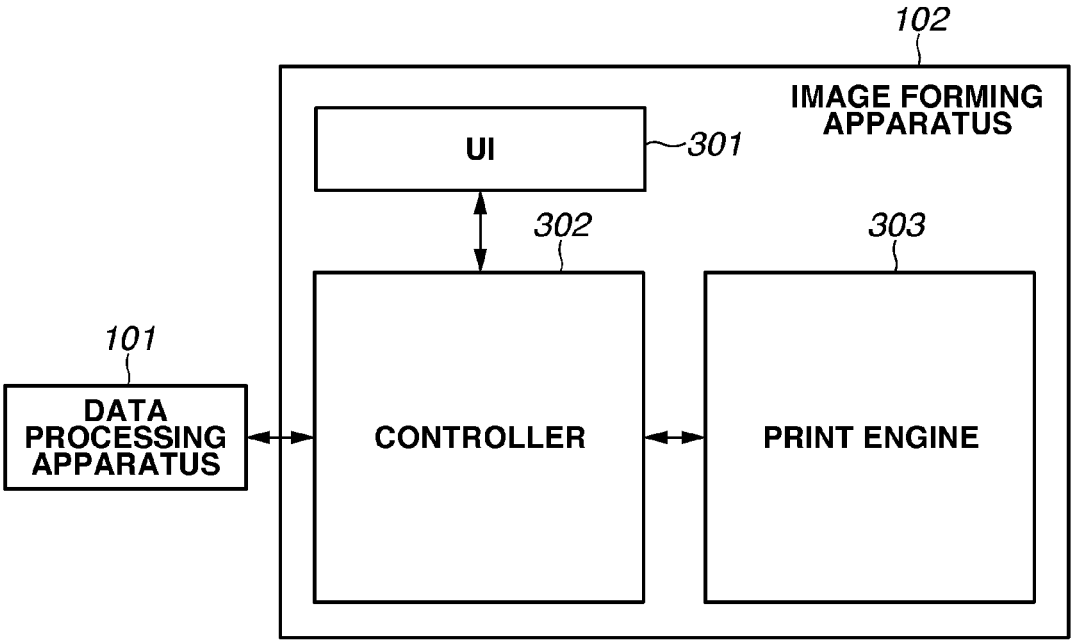
FIG. 1 is a schematic diagram illustrating a system configuration of an image forming apparatus according to a first exemplary embodiment of the present invention.

FIG. 1 is a block diagram illustrating a configuration of an image forming apparatus according to a first exemplary embodiment of the present invention.

A data processing apparatus 101 (for example, a personal computer (PC)) generates image data and transmits the image data to an image forming apparatus 102.

The image forming apparatus 102 (for example, a laser printer) receives image data from the data processing apparatus 101, and performs image formation on a sheet based on the image data. The image forming apparatus 102 may be a multifunction peripheral having a scanner function, a facsimile function, etc.

A user interface (UI) 301 includes a display unit that transmits various pieces of information to the user and an operation unit that receives various operations from the user. The display unit allows a current value of the toner remaining amount, to be described below, to be displayed thereon. The current value of the toner remaining amount may be transmitted to an external apparatus, such as the data processing apparatus 101, via an external interface (I/F), to be displayed on a display unit included in the external apparatus, such as the data processing apparatus 101.

A controller 302 generates bitmap data based on page-description language (PDL) data, and transmits the bitmap data to a print engine 303. The details of the controller 303 are described below with reference to FIG. 2.

The print engine 303 performs image formation on a sheet using toner in an electrophotographic method based on bitmap data received from the controller 302. The method for image formation is not limited to the electrophotographic method, but may be, for example, an inkjet method. In such cases, the recording material in the electrophotographic method is toner, and the recording material in the inkjet method is ink.

While, in the present exemplary embodiment, the controller 302 and the print engine 303 are separate from each other, the controller 302 and the print engine 303 may be integrated.

(Description of System Configuration of Controller)

Figure 2:
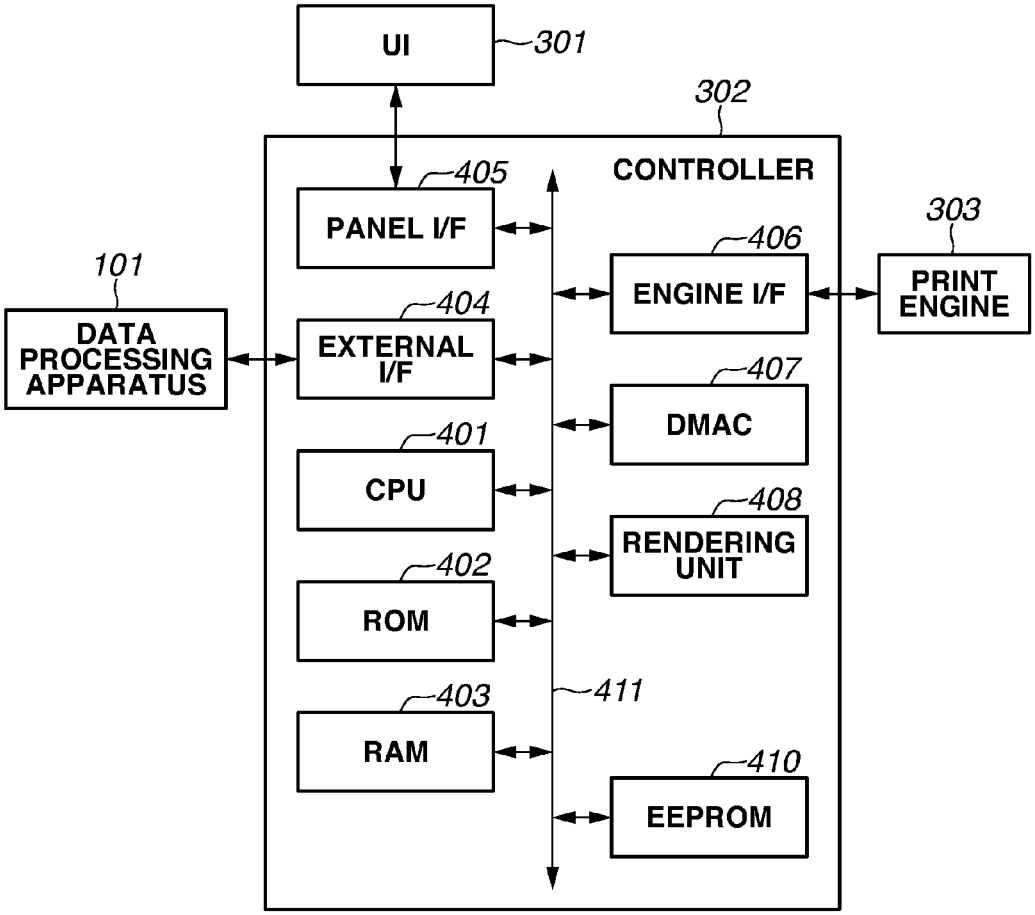
FIG. 2 is a block diagram illustrating a configuration example of a controller according to the first exemplary embodiment.

FIG. 2 is a block diagram illustrating a configuration of the controller 302.

A central processing unit (CPU) 401 loads a program stored in a read-only memory (ROM) 402 onto a random access memory (RAM) 403, and executes the program to control the image forming apparatus 102. Also, the CPU 401 calculates a toner remaining amount based on a predicted value of a toner consumption amount converted from a dot count value obtained by a dot counting unit 604 (FIG. 4) and a sensor value of a toner remaining amount of which notice is given from the print engine 303, as described below. Then, the CPU 401 displays the calculated toner remaining amount on the UI 301 via a panel I/F 405, or notifies the data processing apparatus 101 via an external I/F 404 of the calculated toner remaining amount.

The ROM 402 stores a program to be executed by the CPU 401.

The RAM 403 stores the program loaded from the ROM 402. The RAM 403 further stores PDL data, intermediate data generated by interpreting the PDL data, bitmap data generated by rendering the intermediate data, various processing statuses temporarily required for other processing, and log information.

The external I/F 404 interconnects the data processing apparatus 101 and the controller 302, and relays interactive data communication, i.e., transmission and reception of data.

The panel I/F 405 interconnects the UI 301 and the controller 302, and relays interactive data communication, i.e., transmission and reception of data.

An engine I/F 406 interconnects the print engine 303 and the controller 302, and relays interactive data communication, i.e., transmission and reception of data.

A direct media access controller (DMAC) 407 receives an instruction from the CPU 401 and performs, in response to the instruction, data access, i.e., writing and reading of data, with respect to the RAM 403.

A rendering unit 408 rasterizes intermediate data into bitmap data.

An electrically erasable programmable read-only memory (EEPROM) 410 stores setting information of the image forming apparatus 102.

A bus 411 interconnects various units included in the controller 302.

(Description of System Configuration of Print Engine)

Figure 3:
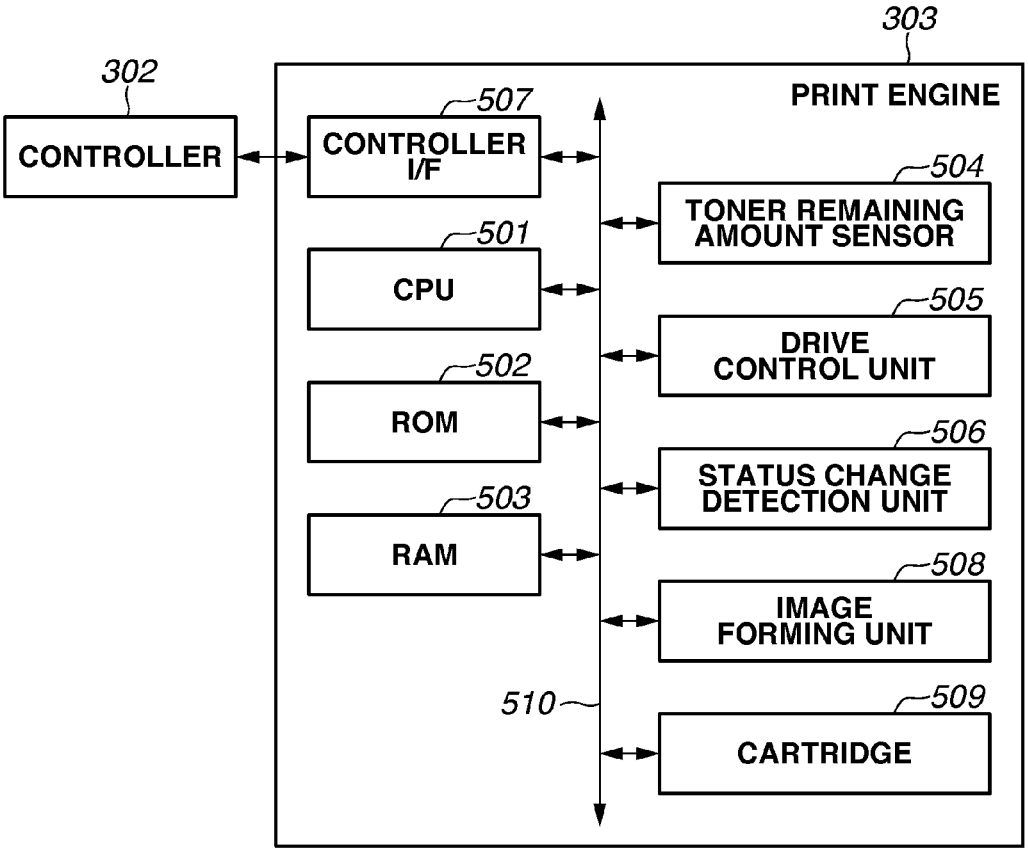
FIG. 3 is a block diagram illustrating a configuration example of a print engine according to the first exemplary embodiment.

FIG. 3 is a block diagram illustrating a configuration of the print engine 303.

A CPU 501 loads a program stored in a ROM 502 onto a RAM 503 and executes the program to control the print engine 303.

The ROM 502 stores the program to be executed by the CPU 501.

The RAM 503 stores the program loaded from the ROM 502.

A toner remaining amount sensor 504 measures the remaining amount of toner contained in a cartridge 509. The method for detecting the toner remaining amount by the toner remaining amount sensor 504 includes, for example, a permeability detection method, a magnet method, a piezoelectric oscillation method, and a light transmission method. The toner remaining amount sensor 504 detects, as a sensor value, each predetermined value which the toner remaining amount has reached, such as 20% and 0%. In other words, when the remaining amount is in the range of 100% to 21%, the toner remaining amount sensor 504 detects 100%. When the remaining amount is in the range of 20% to 1%, the toner remaining amount sensor 504 detects 20%. When the remaining amount is 0%, the toner remaining amount sensor 504 detects 0%. Incidentally, the toner remaining amount sensor 504 may be mounted within the cartridge 509.

A drive control unit 505 drives various motors required for an image forming unit 508 to perform image formation.

A status change detection unit 506 detects a status change, such as jam and cover-open, in the image forming apparatus 102. Also, the status change detection unit 506 detects replacement of the cartridge 509. Incidentally, the CPU 501 may detect such a status change.

A controller I/F 507 interconnects the controller 302 and the print engine 303, and relays interactive data communication, i.e., transmission and reception of data.

The image forming unit 508 performs image formation on a sheet using toner in the electrophotographic method based on bitmap data received from the controller 302.

The cartridge 509, which is a storage unit storing toner to be used by the image forming unit 508 to perform image formation, is a process cartridge that is loadable into the image forming apparatus 102. The cartridge 509 contains a nonvolatile storage medium, in which cartridge information is stored. The cartridge information includes, for example, information indicating whether the cartridge 509 is a new one, color information indicating color of toner of the cartridge 509, and toner remaining amount information indicating the current toner remaining amount of the cartridge 509. While, in the present exemplary embodiment, the cartridge 509 is connected to a bus 510, the cartridge 509 may be connected to the CPU 501 via a dedicated line.

The bus 510 interconnects various units included in the print engine 303.

Figure 4:
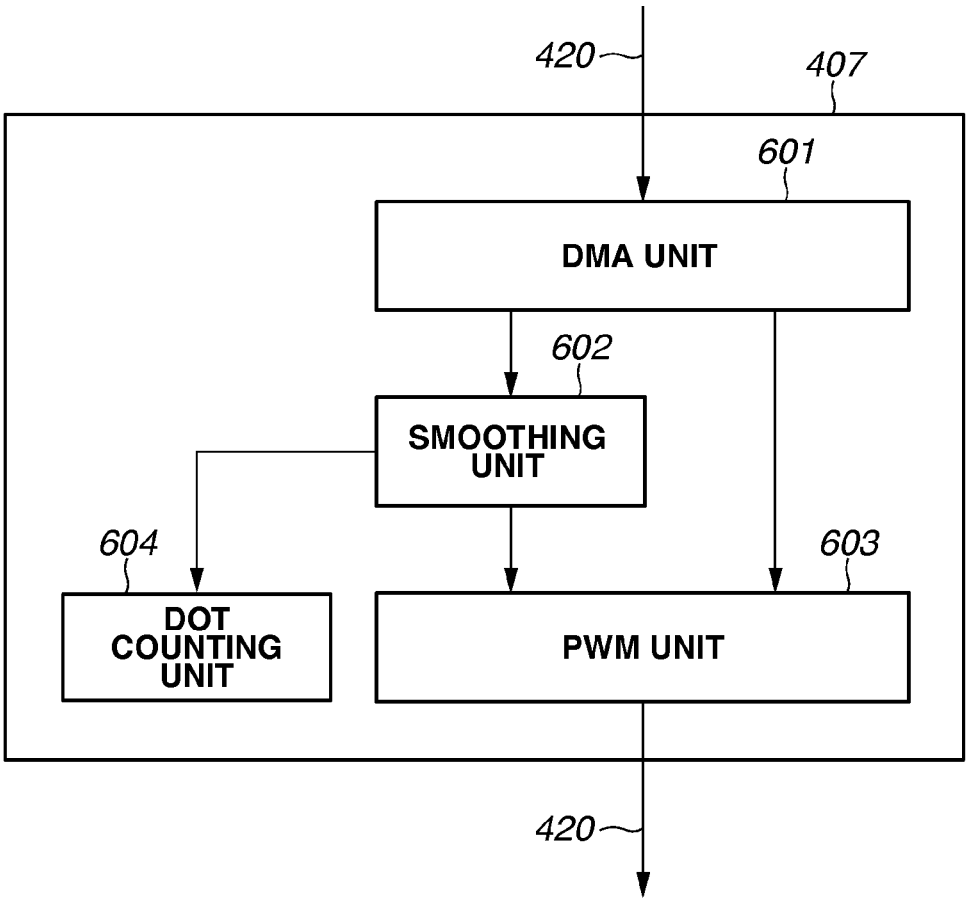
FIG. 4 is a block diagram illustrating a configuration example of a direct media access controller (DMAC) according to the first exemplary embodiment.

FIG. 4 is a block diagram illustrating a configuration example of the DMAC 407 according to the first exemplary embodiment.

A direct media access (DMA) unit 601 receives data from hardware connected to a signal line 420 and outputs data to a smoothing unit 602 and a pulse width modulation (PWM) unit 603 based on values previously set in the DMA unit 601.

The smoothing unit 602 performs smoothing processing on input data and outputs the processed data to the dot counting unit 604 and the PWM unit 603.

The PWM unit 603 converts input data into the PWM format and outputs the converted data to the signal line 420, the engine I/F 406, and the print engine 303.

The dot counting unit 604 counts the number of dots for which toner is consumed during execution of image formation from among dots included in the rasterized bitmap data. More specifically, the dot counting unit 604 counts the number of dots of color other than white. For example, in the case of monochromatic printing, the dot counting unit 604 counts the number of dots corresponding to black (K). In the case of color printing, the dot counting unit 604 counts the number of dots corresponding to any one of yellow (Y), magenta (M), cyan (C), and black (K). Incidentally, the CPU 401 or the rendering unit 408 may count the number of dots.

(Description of Control Processing for Toner Remaining Amount Detection)

Figure 5:
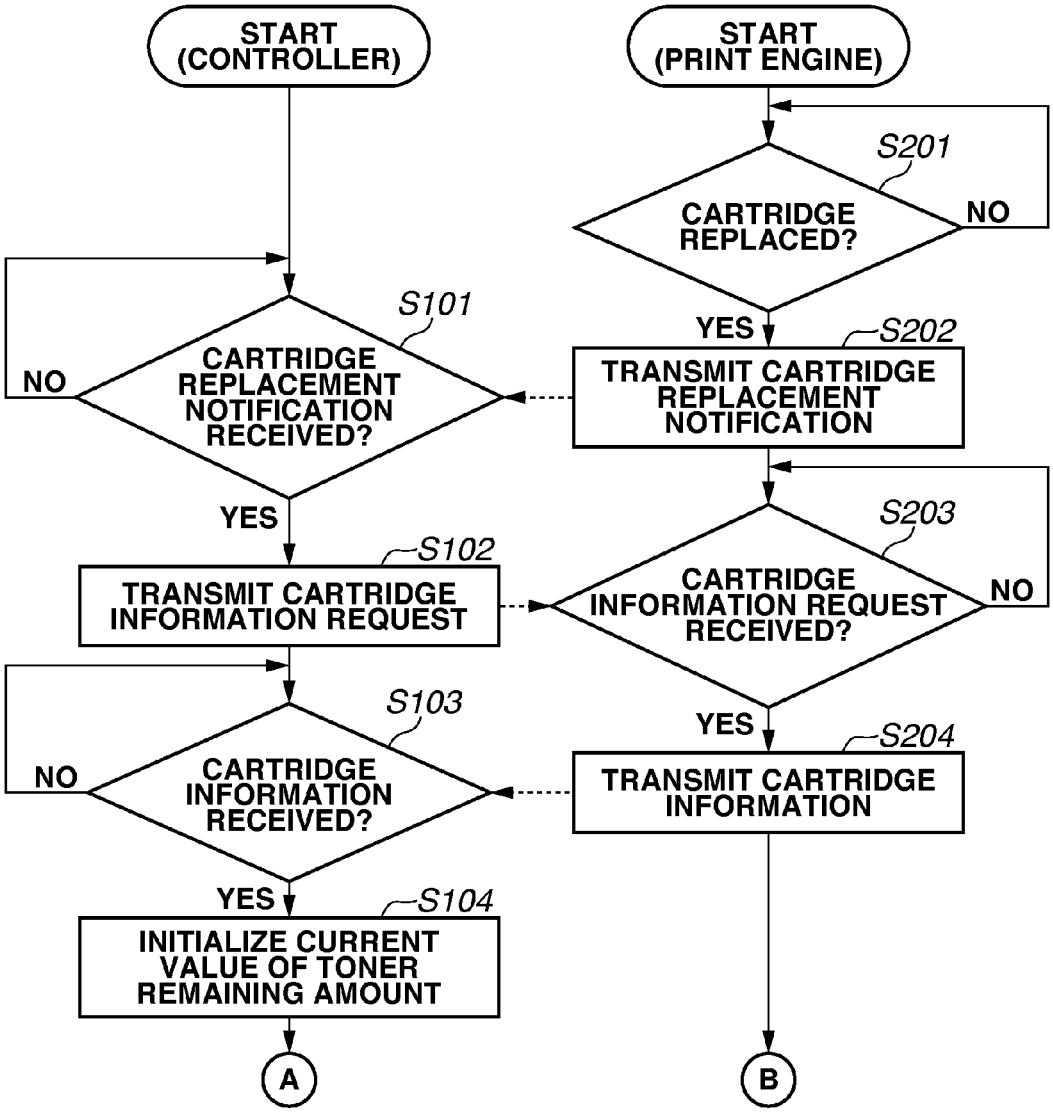
FIG. 5 is a flowchart (the first half) illustrating control of toner remaining amount detection according to the first exemplary embodiment.
Figure 6:
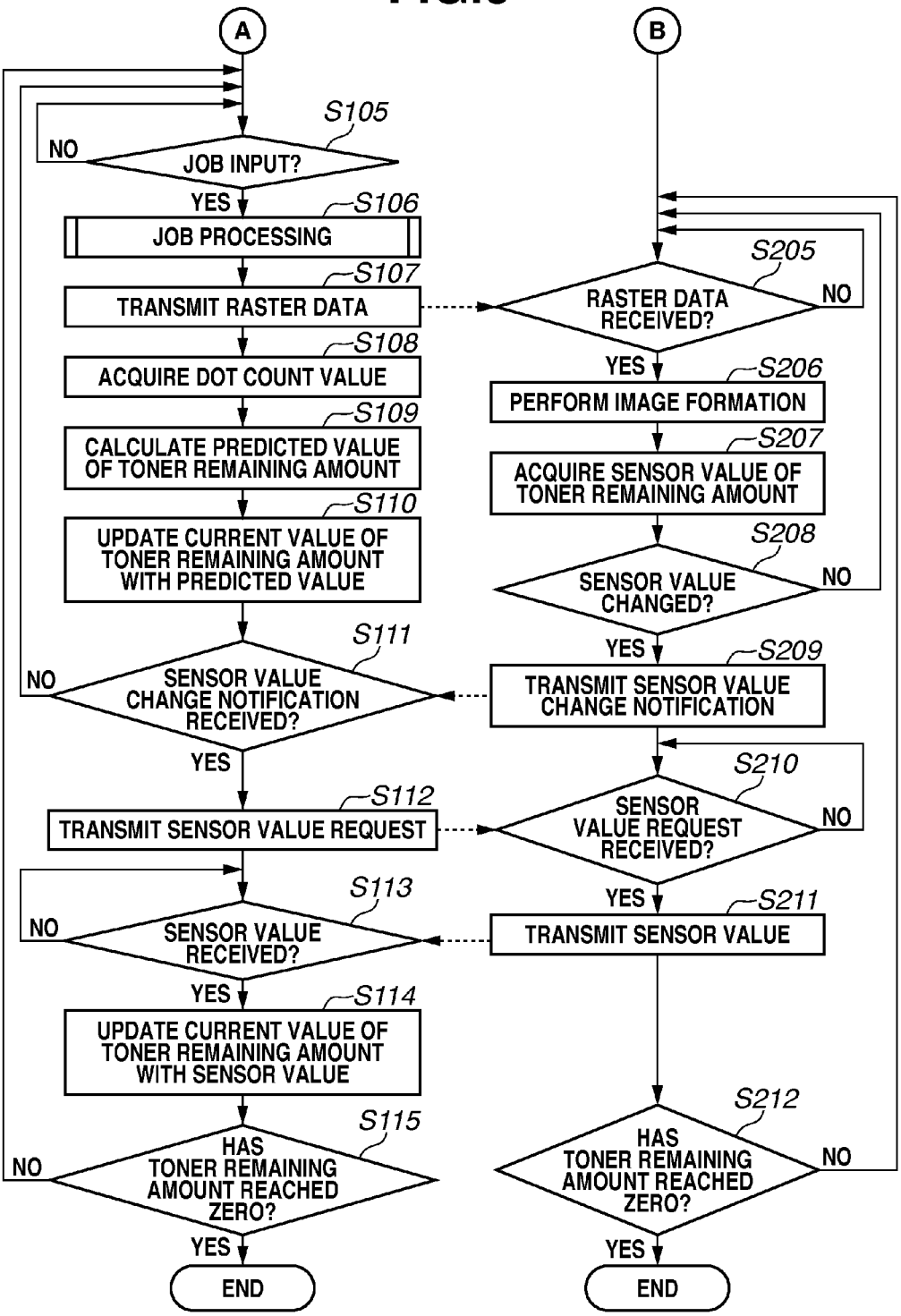
FIG. 6 is a flowchart (the second half) illustrating control of toner remaining amount detection according to the first exemplary embodiment.

FIGS. 5 and 6 are flowcharts illustrating control for toner remaining amount detection.

The control illustrated in the left half of the flowchart of each of FIGS. 5 and 6 is implemented by the CPU 401 in the controller 302 loading a control program stored in the ROM 402 onto the RAM 403 and executing the control program. The control illustrated in the right half of the flowchart of each of FIGS. 5 and 6 is implemented by the CPU 501 in the print engine 303 loading a control program stored in the ROM 502 onto the RAM 503 and executing the control program.

First, in step S201, the CPU 501 determines whether the cartridge 509 has been replaced. The cartridge 509 having been replaced can be recognized by the status change detection unit 506 detecting the replacement of the cartridge 509 and notifying the CPU 501. The replacement of the cartridge 509 is detected by a button or switch the on/off state of which changes in hardware manner depending on the attachment or detachment of a component. However, other methods may be employed for detection. If it is determined that the cartridge 509 has been replaced (YES in step S201), the processing proceeds to step S202. If it is determined that the cartridge 509 has not been replaced (NO in step S201), the processing waits.

In step S202, the CPU 501 transmits, to the controller 302 via the controller I/F 507, a cartridge replacement notification indicating that the cartridge 509 has been replaced.

Then, in step S101, the CPU 401 determines whether the cartridge replacement notification has been received from the print engine 303 via the engine I/F 406. If it is determined that the cartridge replacement notification has been received (YES in step S101), the processing proceeds to step S102. If it is determined that the cartridge replacement notification has not been received (NO in step S101), the processing waits.

In step S102, the CPU 401 transmits, to the print engine 303 via the engine I/F 406, a cartridge information request for requesting cartridge information of the cartridge 509.

Then, in step S203, the CPU 501 determines whether the cartridge information request has been received from the controller 302 via the controller I/F 507. If it is determined that the cartridge information request has been received (YES in step S203), the processing proceeds to step S204. If it is determined that the cartridge information request has not been received (NO in step S203), the processing waits.

In step S204, the CPU 501 transmits the cartridge information of the cartridge 509 to the controller 302 via the controller I/F 507.

Then, in step S103, the CPU 401 determines whether the cartridge information has been received from the print engine 303 via the engine I/F 406. If it is determined that the cartridge information has been received (YES in step S103), the processing proceeds to step S104. If it is determined that the cartridge information has not been received (NO in step S103), the processing waits.

In step S104, the CPU 401 initializes a current value of the toner remaining amount based on the cartridge information. The current value of the toner remaining amount is a value recognized by the controller 302 as the toner remaining amount of the cartridge 509 and is also a value displayed to the user via the UI 301. More specifically, the CPU 401 initializes the current value of the toner remaining amount in such a way that the CPU 401 refers to the cartridge information and, when finding that the cartridge 509 is a new one, sets the current value of the toner remaining amount to 100%. Also, when not finding that the cartridge 509 is a new one, the CPU 401 sets the current value of the toner remaining amount to a value corresponding to toner remaining amount information included in the cartridge information.

In step S105, the CPU 401 determines whether a job to be executed for image formation has been input from the data processing apparatus 101 via the host I/F 404. The job includes PDL data. If it is determined that the job has been input (YES in step S105), the processing proceeds to step S106. If it is determined that the job has not been input (NO in step S105), the processing waits.

In step S106, the CPU 401 performs image processing required for image formation based on the print job. The image processing includes processing for controlling the rendering unit 408 to rasterize PDL data and to generate raster data.

In step S107, the CPU 401 transmits the raster data generated by the image processing to the print engine 303 via the engine I/F 406.

In step S108, the CPU 401 acquires, from the dot counting unit 604, a dot count value measured during generation of the raster data. The dot count value may be acquired on a page-by-page basis or on a job-by-job basis.

In step S109, the CPU 401 calculates a predicted value of the toner remaining amount, which would be obtained after execution of image formation, based on the dot count value. More specifically, the CPU 401 performs a calculation of "(the dot count value during execution of printing for the current job or page [dot])×(the toner consumption amount per dot [g/dot])=(the toner consumption amount obtained by the current job execution [g])". Next, the CPU 401 performs a calculation of "(the current toner remaining amount [g])−(the toner consumption amount obtained by the current job execution [g])=(a new toner remaining amount [g])". Then, the CPU 401 performs a calculation of "(the new toner remaining amount [g])/(the toner remaining amount in the unused state of the cartridge)=(a predicted value of the new toner remaining amount [%])".

In step S110, the CPU 401 updates the current value of the toner remaining amount with the calculated predicted value.

On the other hand, in step S205, the CPU 501 determines whether the raster data has been received from the controller 302 via the controller I/F 507. If it is determined that the raster data has been received (YES in step S205), the processing proceeds to step S206. If it is determined that the raster data has not been received (NO in step S205), the processing waits.

In step S206, the CPU 501 controls the image forming unit 508 to perform image formation based on the raster data.

In step S207, the CPU 501 acquires a sensor value of the toner remaining amount from the toner remaining amount sensor 504. The timing at which to acquire the sensor value may be timing at which image formation has been completed on a page-by-page basis or timing at which image formation has been completed on a job-by-job basis. Alternatively, the timing at which to acquire the sensor value may be each time a predetermined time has elapsed.

In step S208, the CPU 501 determines whether the currently acquired sensor value has changed from the previously acquired sensor value. If it is determined that the currently acquired sensor value has changed (YES in step S208), the processing proceeds to step S209. If it is determined that the currently acquired sensor value has not changed (NO in step S208), the processing returns to step S205.

In step S209, the CPU 501 transmits, to the controller 302 via the controller I/F 507, a sensor value change notification indicating that the sensor value has changed.

Then, in step S111, the CPU 401 determines whether the sensor value change notification has been received from the print engine 303 via the engine I/F 406. If it is determined that the sensor value change notification has been received (YES in step S111), the processing proceeds to step S112. If it is determined that the sensor value change notification has not been received (NO in step S111), the processing returns to step S105.

In step S112, the CPU 401 transmits, to the print engine 303 via the engine I/F 406, a sensor value request for requesting the sensor value.

Then, in step S210, the CPU 501 determines whether the sensor value request has been received from the controller 302 via the controller I/F 507. If it is determined that the sensor value request has been received (YES in step S210), the processing proceeds to step S211. If it is determined that the sensor value request has not been received (NO in step S210), the processing waits.

In step S211, the CPU 501 transmits the sensor value to the controller 302 via the controller I/F 507.

Then, in step S113, the CPU 401 determines whether the sensor value has been received from the print engine 303 via the engine I/F 406. If it is determined that the sensor value has been received (YES in step S113), the processing proceeds to step S114. If it is determined that the sensor value has not been received (NO in step S113), the processing waits.

In step S114, the CPU 401 updates the current value of the toner remaining amount with the sensor value.

In step S115, the CPU 401 determines whether the toner remaining amount has reached zero by referring to the current value of the toner remaining amount. If it is determined that the toner remaining amount has reached zero (YES in step S115), the processing ends. If it is determined that the toner remaining amount has not reached zero (NO in step S115), the processing returns to step S105.

On the other hand, in step S212, the CPU 501 determines whether the toner remaining amount has reached zero by referring to the sensor value of the toner remaining amount. If it is determined that the toner remaining amount has reached zero (YES in step S212), the processing ends. If it is determined that the toner remaining amount has not reached zero (NO in step S212), the processing returns to step S205.

(Description of Processing for Updating Toner Remaining Amount)

Figure 7:
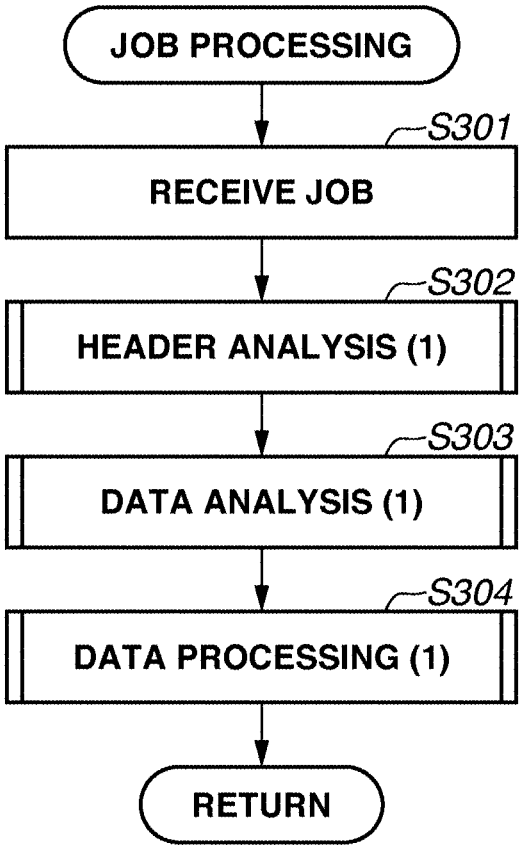
FIG. 7 is a flowchart illustrating toner remaining amount update processing according to the first exemplary embodiment.

FIG. 7 is a flowchart illustrating processing for updating the toner remaining amount.

In step S301, when having received print job data from the data processing apparatus 101 via the external I/F 404, the CPU 401 stores the print job data into the RAM 403.

In step S302, after storing the print job data into the RAM 403, the CPU 401 analyzes a header portion of the print job data.

Figure 11A:
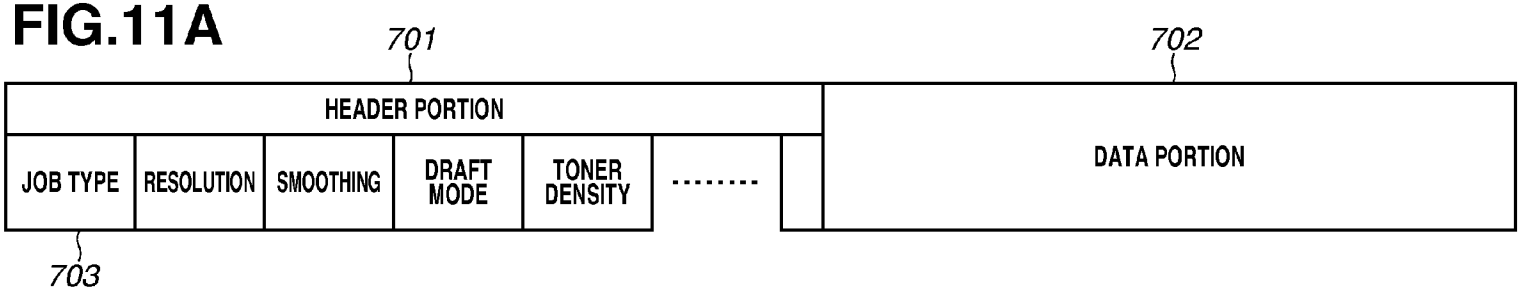
FIGS. 11A, 11B, and 11C are block diagrams respectively illustrating an example of a data structure of a print job, an example of a data structure of setting values of a job stored in the controller, and an example of a data structure of setting values of a page according to the first exemplary embodiment.

The print job data is composed of a header portion 701 and a data portion 702, as illustrated in FIG. 11A. In the header portion 701, setting values 703 concerning the entire print job, such as the resolution of the print job and a setting value of smoothing, are stored. In the data portion 702, image data described in a PDL language is stored.

In step S303, after analyzing the header portion 701 of the print job data, the CPU 401 analyzes the data portion 702 of the print job data.

In step S304, after analyzing the data portion 702 of the print job data, the CPU 401 performs data processing on the print job data based on a result of analysis of the header portion 701 and a result of analysis of data portion 702.

Figure 8:
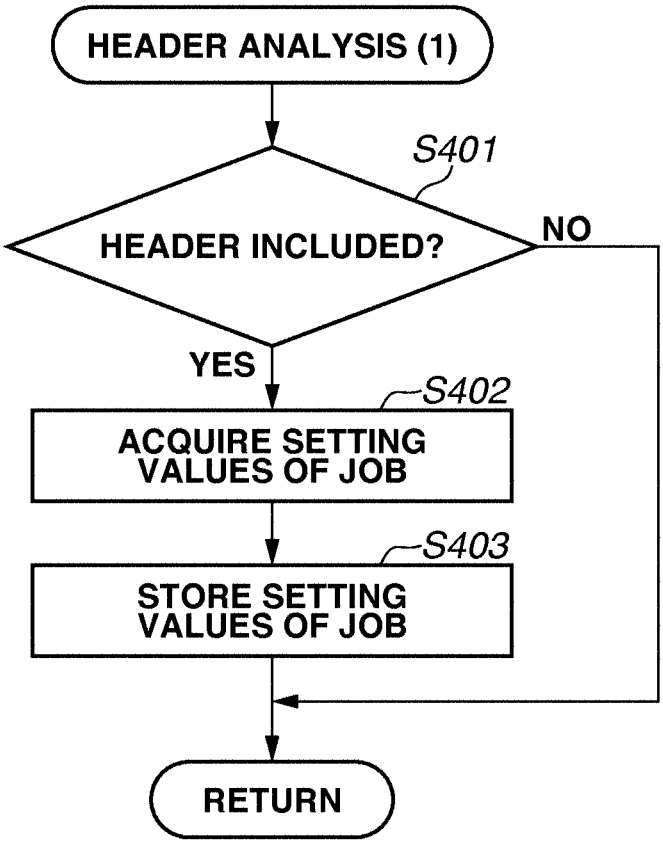
FIG. 8 is a flowchart illustrating a header analysis processing procedure for a received print job according to the first exemplary embodiment.

FIG. 8 is a flowchart illustrating a header analysis processing procedure for the received print job according to the first exemplary embodiment.

In step S401, the CPU 401 checks whether the header portion 701 is included in the print job data stored in the RAM 403.

If it is determined that the header portion 701 is included in the print job data stored in the RAM 403 (YES in step S401), then in step S402, the CPU 401 acquires the setting values 703 stored in the header portion 701, such as the resolution and the setting value of smoothing.

In step S403, the CPU 401 stores, into the RAM 403, the setting values 703 acquired from the header portion 701, such as the resolution and the setting value of smoothing.

Figure 11B:
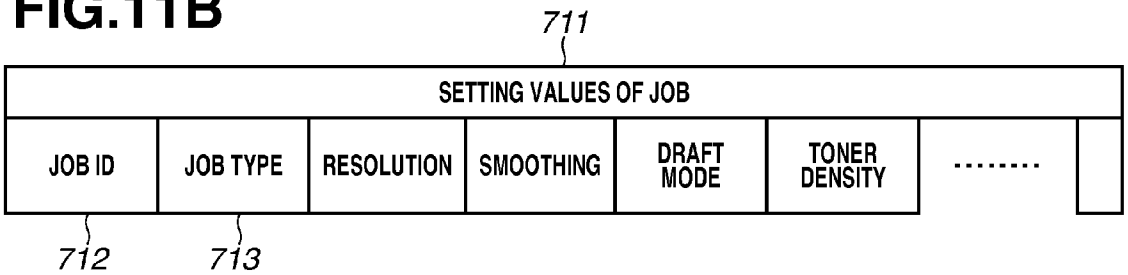

The above-mentioned setting values 703 are stored in the RAM 403 in association with a job identifier (ID) 712 for identifying the print job, as illustrated in FIG. 11B.

Figure 9:
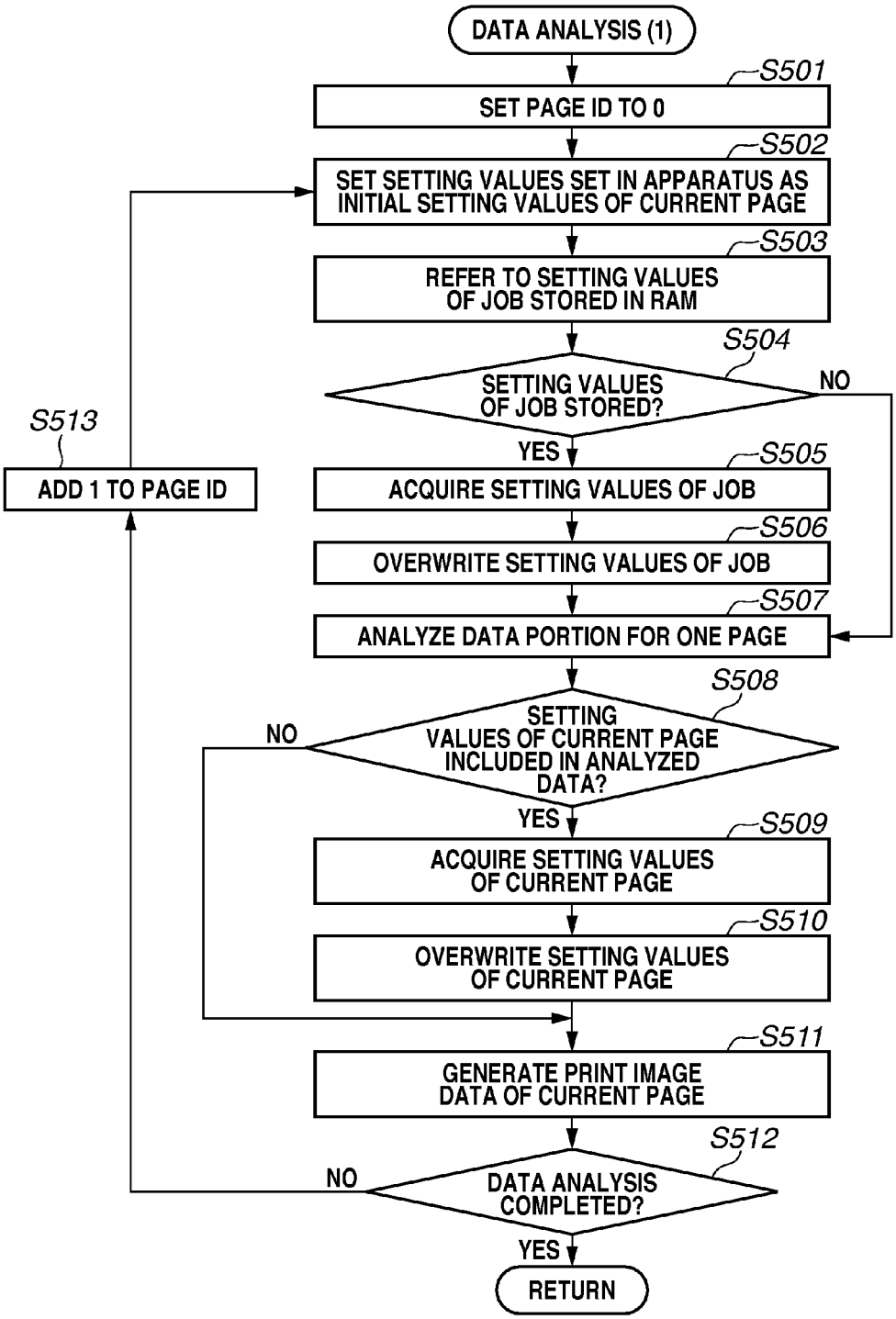
FIG. 9 is a flowchart illustrating a data analysis processing procedure for the received print job according to the first exemplary embodiment.

FIG. 9 is a flowchart illustrating a data analysis processing procedure for the received print job according to the first exemplary embodiment.

Since the data portion 702 of the print job data may include a plurality of pages, in step S501, the CPU 401 sets the page ID to "0" at the time of start of data analysis and performs the following processing.

In step S502, the CPU 401 stores, into the RAM 403, the setting values including the resolution and smoothing of the image forming apparatus 102, which is stored in the EEPROM 410, as setting values of the current page of the print job data.

Figure 11C:
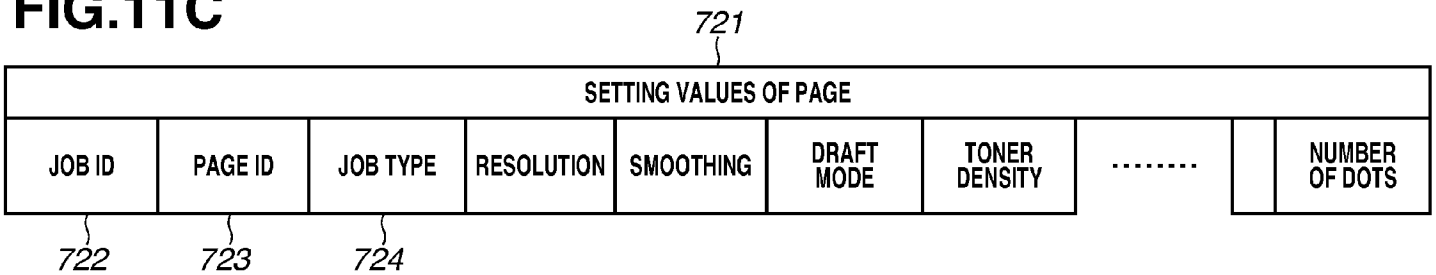

The above-mentioned setting values 721 are stored in the RAM 403 in association with a job ID 722 for identifying the print job and a page ID 723, as illustrated in FIG. 11C.

In step S503, the CPU 401 refers to the setting values 711 of the job stored in the RAM 403.

If the setting values 711 of the job corresponding to the job ID subjected to data analysis are stored in the RAM 403 (YES in step S504), then in step S505, the CPU 401 acquires the setting values 711.

In step S506, the CPU 401 overwrites the setting values 721 of the current page of the print job data stored in the RAM 403 with the acquired setting values 711.

In step S507, the CPU 401 performs PDL analysis for one page on the data portion 702 of the print job data stored in the RAM 403.

If, as a result of analysis, the setting values of the current page are included in the data portion 702 (YES in step S508), then in step S509, the CPU 401 acquires the setting values, and, in step S510, the CPU 401 overwrites the setting values 721 of the current page of the print job data stored in the RAM 403 with the acquired setting values.

In step S511, the CPU 401 causes the rendering unit 408 to generate print image data of the current page from the intermediate data stored in the RAM 403, and stores the print image data into the RAM 403.

If any unanalyzed portion is present in the data portion 702 of the print job data stored in the RAM 403 (NO in step S512), the processing proceeds to step S513. If no unanalyzed portion is present in the data portion 702 of the print job data stored in the RAM 403 (YES in step S512), the CPU 401 terminates the analysis of the print job data.

In step S513, the CPU 401 increments the current page by one page, and the processing then returns to step S502.

Figure 10:
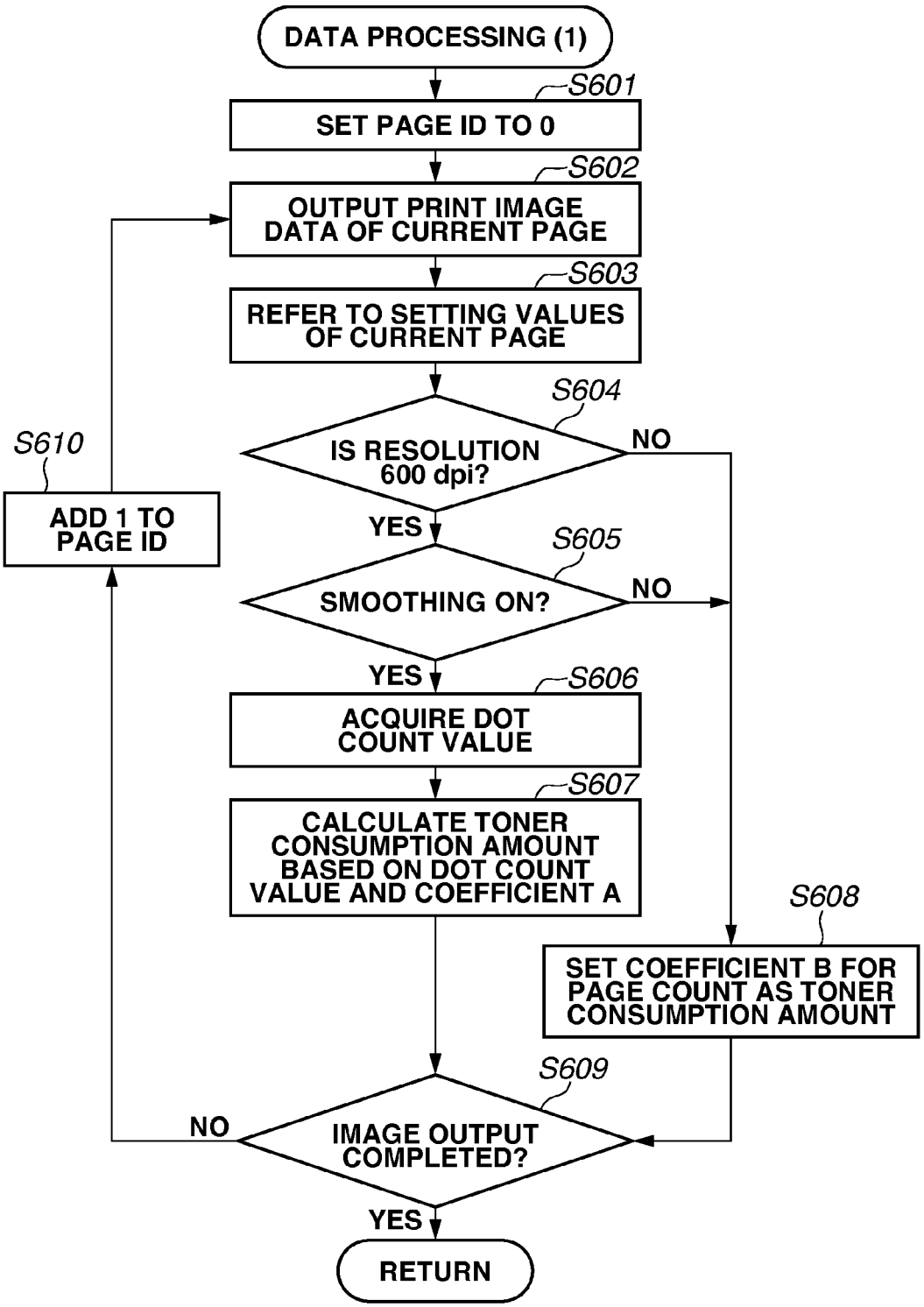
FIG. 10 is a flowchart illustrating a data processing procedure for the received print job according to the first exemplary embodiment.

FIG. 10 is a flowchart illustrating a data processing procedure for the received print job according to the first exemplary embodiment.

Since the data portion 702 of the print job data may include a plurality of pages, in step S601, the CPU 401 sets the page ID to "0" at the time of start of data processing and performs the following processing.

The CPU 401 enables the function of the dot counting unit 604. Next, the CPU 401 configures the settings for the DMA unit 601, the smoothing unit 602, and the PWM unit 603 based on the setting information of the current page stored in the RAM 403. Then, in step S602, the CPU 401 outputs print image data stored in the RAM 403 to the DMA unit 601.

In a case where the resolution is set to 600 dots per inch (dpi) and the smoothing is set to ON, the print image data is output to the dot counting unit 604 and the PWM unit 603 via the DMA unit 601 and the smoothing unit 602 in the DMAC 407. When the print image data is input to the dot counting unit 604, the dot counting unit 604 counts the number of dots of the print image data. When the print image data is input to the PWM unit 603, the PWM unit 603 converts the print image data into the PWM format, and outputs the converted data to the print engine 303 via the engine I/F 406.

In a case where the resolution is set to other than 600 dpi or the smoothing is set to OFF, the print image data is output to the PWM unit 603 via the DMA unit 601 in the DMAC 407. Since the print image data is not input to the dot counting unit 604, the dot counting unit 604 does not count the number of dots of the print image data. When the print image data is input to the PWM unit 603, the PWM unit 603 converts the print image data into the PWM format, and outputs the converted data to the print engine 303 via the engine I/F 406.

In step S603, after outputting the print image data of the current page, the CPU 401 refers to the setting values 721 of the current page stored in the RAM 403.

If, as a result of referring to the setting values 721, the resolution is 600 dpi (YES in step S604), the processing proceeds to step S605. If the resolution is other than 600 dpi (NO in step S604), the processing proceeds to step S608.

If the smoothing is ON in the setting values of the current page (YES in step S605), the processing proceeds to step S606. If the smoothing is other than ON (NO in step S605), the processing proceeds to step S608.

In step S606, the CPU 401 acquires the number of dots of the print image data of the current page from the dot counting unit 604.

In step S607, the CPU 401 calculates the toner consumption amount of the current page based on the acquired number of dots and a previously stored coefficient A, and stores the calculated toner consumption amount into the RAM 403.

In step S608, the CPU 401 sets a previously stored coefficient B as the toner consumption amount of the current page, and stores the set toner consumption amount into the RAM 403.

If any print image data that has not yet been output is left in the print job data stored in the RAM 403 (NO in step S609), the processing proceeds to step S610. If no print image data that has not yet been output is left in the print job data stored in the RAM 403 (YES in step S609), the CPU 401 terminates data processing of the print job data.

In step S610, the CPU 401 increments the current page by one page, and the processing then returns to step S602.

(Description of Basic Transition of Toner Remaining Amount Calculated Value)

Figure 12:
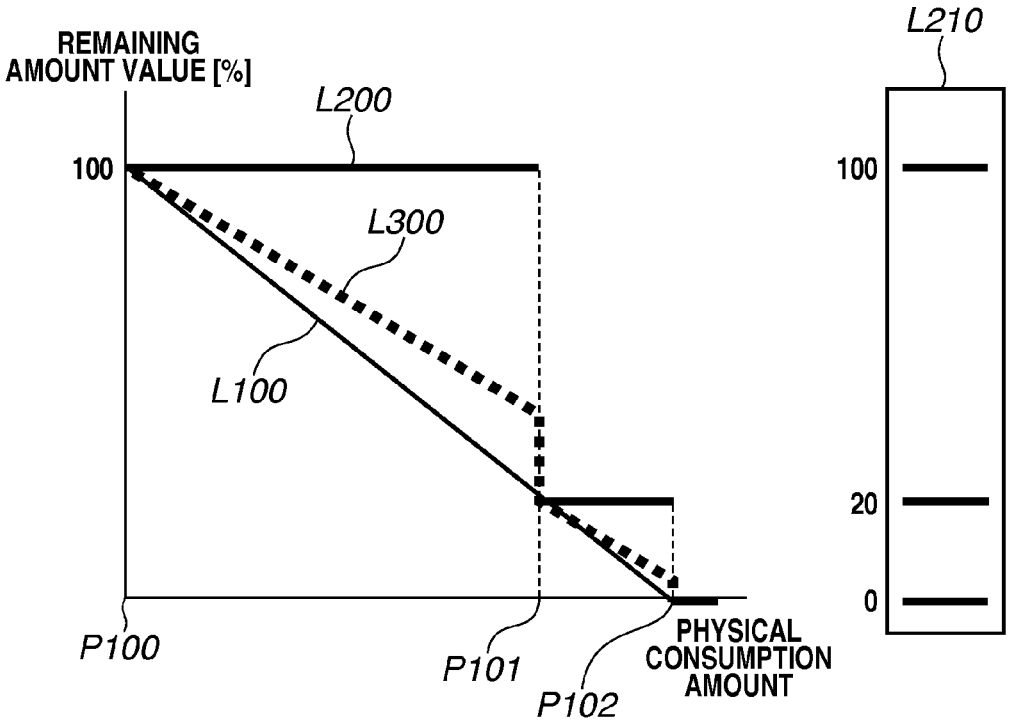
FIG. 12 illustrates a transition of a toner remaining amount calculated value.

FIG. 12 illustrates a transition of the toner remaining amount.

Line L100 indicates a transition of the actual toner remaining amount. The actual toner remaining amount is an accurate value of the actually present toner remaining amount, and is very difficult to directly acquire unless, for example, the sensor is extremely precise over the entire range.

Line L200 indicates a transition of the sensor value of the toner remaining amount.

A scale L210 indicates values which the sensor value of the toner remaining amount can take. In this example, the values which the sensor value of the toner remaining amount can take are 100%, 20%, and 0%, and 20% is set as a threshold value at low level (a state close to toner runout as a criterion for replacement of cartridges).

Line L300 indicates a transition of the current value of the toner remaining amount.

Points P100 to P102 indicate physical consumption amounts. The relationship between the respective points and the current values is as follows.

Point P100 corresponds to the time when, in step S104, the CPU 401 initializes the current value of the toner remaining amount to 100% at the time of replacement of cartridges.

An interval from point P100 to point P101 corresponds to an interval in which, until the sensor value of the toner remaining amount changes from 100% to 20%, the CPU 401 repeats the loop of steps S105 to S111 to continue calculating a predicted value of the toner remaining amount and updating the current value of the toner remaining amount.

Point P101 is a point of time when the current value of the toner remaining amount suddenly changes, and corresponds to the time when, in response to the change of the sensor value of the toner remaining amount from 100% to 20%, the CPU 401 has updated the current value of the toner remaining amount to 20% with the sensor value of the toner remaining amount in step S114.

An interval from point P101 to point P102 corresponds to an interval in which, until the sensor value of the toner remaining amount changes from 20% to 0%, the CPU 401 repeats the loop of steps S105 to S111 to continue calculating a predicted value of the toner remaining amount and updating the current value of the toner remaining amount.

Point P102 is a point of time when the current value of the toner remaining amount suddenly changes, and corresponds to the time when, in response to the change of the sensor value of the toner remaining amount from 20% to 0%, the CPU 401 has updated the current value of the toner remaining amount to 0% with the sensor value of the toner remaining amount in step S114.

(Description of Effect of Toner Remaining Amount Calculation in First Exemplary Embodiment)

Figure 13A:
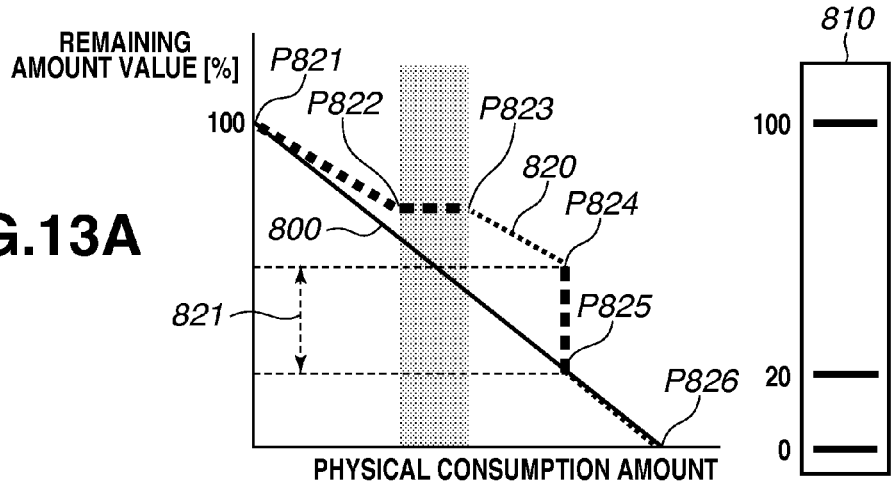
FIGS. 13A, 13B, and 13C illustrate effects of toner remaining amount calculation according to the first exemplary embodiment.
Figure 13B:
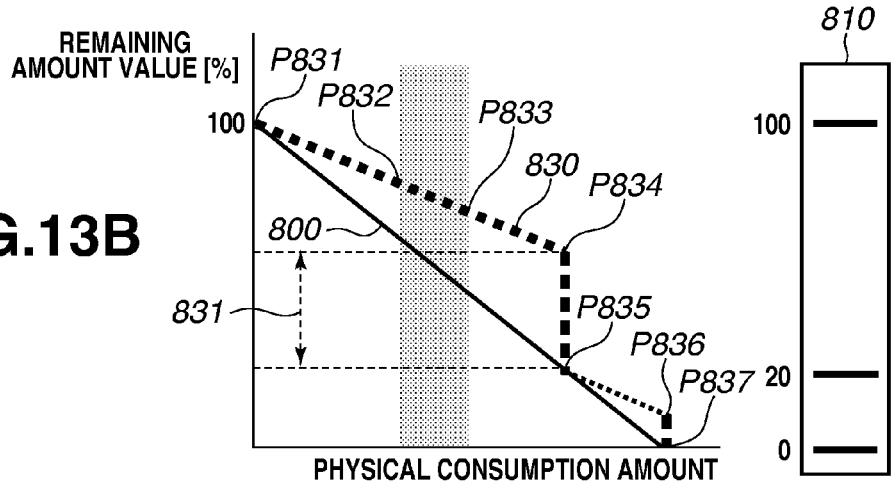
Figure 13C:
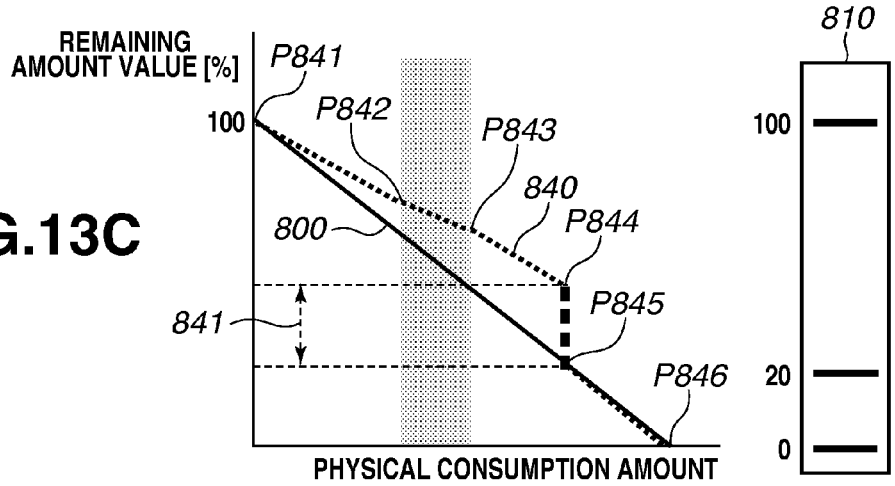

FIGS. 13A, 13B, and 13C illustrate the effects of toner remaining amount calculation according to the first exemplary embodiment.

FIG. 13A illustrates a transition of the toner remaining amount calculated value in a conventional case where the toner remaining amount value is calculated only with respect to a print job in which the dot count value can be obtained.

Line 800 indicates an ideal transition of the notification remaining amount value in a case where it is supposed that the same consumption amount as the physical consumption amount can be acquired.

A scale 810 indicates an example of points of the sensor remaining amount value (%) of which notice can be given from the print engine 303. In this example, the sensor remaining amount values of which notice can be given from the print engine 303 are 100%, 20%, and 0%, and 20% is set as a threshold value at low level.

Line 820 indicates a transition of the notification remaining amount value in a case where the toner remaining amount value is calculated only with respect to a print job in which the dot count value can be obtained.

Each of an interval from point P821 to P822 and an interval from point P823 to point P824 is an interval in which a print job in which the dot count value can be obtained is being executed. In this interval, the transition is plotted according to the toner remaining amount value calculated based on the dot count value obtained during execution of the print job.

An interval from point P822 to point P823 is an interval in which a print job in which the dot count value cannot be obtained is being executed. Therefore, the toner remaining amount in the interval from point P822 to point P823 remains unchanged.

In an interval from point P824 to point P825, an abrupt transition occurs in the toner remaining amount value due to the notification of the sensor remaining amount value of which notice can be given from the print engine 303.

A double-headed arrow 821 indicates a difference between the notification remaining amount value obtained in a case where the toner remaining amount is calculated only with respect to a print job in which the dot count value can be obtained and the ideal notification remaining amount value when notice is given of the sensor remaining amount value from the print engine 303.

FIG. 13B illustrates a transition of the toner remaining amount calculated value in a conventional case where the toner remaining amount is calculated only with respect to a print job in which the dot count value cannot be obtained.

Line 830 indicates a transition of the notification remaining amount value in a case where the toner remaining amount value is calculated by uniformly allocating a coefficient B each time the page is incremented.

In an interval from point P831 to point P834, since the coefficient B is uniformly allocated irrespective of print jobs each time the page is incremented, a deviation from the ideal notification remaining amount value becomes great.

In an interval from point P834 to point P835, an abrupt transition occurs in the toner remaining amount value due to the notification of the sensor remaining amount value of which notice can be given from the print engine 303.

A double-headed arrow 831 indicates a difference between the notification remaining amount value obtained in a case where the toner remaining amount is calculated by uniformly allocating the coefficient B each time the page is incremented and the ideal notification remaining amount value when notice is given of the sensor remaining amount value from the print engine 303.

FIG. 13C illustrates a transition of the toner remaining amount calculated value in a case where the toner remaining amount update processing is performed according to the first exemplary embodiment.

Line 840 indicates a transition of the toner remaining amount calculated value in a case where the toner remaining amount update processing is performed according to the first exemplary embodiment.

Each of an interval from point P841 to P842 and an interval from point P843 to point P844 is an interval in which a print job in which the dot count value can be obtained is being executed. In this interval, the transition of the toner remaining amount value is plotted in the same manner as the line 820 illustrated in FIG. 13A.

An interval from point P842 to point P843 is an interval in which a print job in which the dot count value cannot be obtained is being executed. In this interval, since the coefficient B is uniformly allocated each time the page is incremented, the transition of the toner remaining amount value is plotted in the same manner as the line 830 illustrated in FIG. 13B.

In an interval from point P844 to point P845, a moderate transition occurs in the toner remaining amount value due to the notification of the sensor remaining amount value of which notice can be given from the print engine 303.

A double-headed arrow 841 indicates a difference between the notification remaining amount value obtained in a case where the toner remaining amount update processing is performed according to the first exemplary embodiment and the ideal notification remaining amount value when notice is given of the sensor remaining amount value from the print engine 303.

The double-headed arrow 821 illustrated in FIG. 13A, the double-headed arrow 831 illustrated in FIG. 13B, and the double-headed arrow 841 illustrated in FIG. 13C reveal that the difference between the notification remaining amount value obtained in a case where the toner remaining amount update processing is performed according to the first exemplary embodiment and the ideal notification remaining amount value is less than a difference between a conventional notification remaining amount value and an ideal notification remaining amount value.

As described above, the toner remaining amount update processing according to the first exemplary embodiment enables even an image forming apparatus having such a hardware configuration that only a specific data path is compatible with the dot count function to calculate a precise toner remaining amount value.

In the above-described first exemplary embodiment, in a case where the setting information of the current page is a value indicating that data cannot be input to the dot counting unit 604 in the data processing of a print job, the coefficient B is uniformly calculated as the toner remaining amount value. However, in a case where the draft mode is set or a case where the setting information indicates outputting at a density lower than usual, if the coefficient B is uniformly calculated as the toner remaining amount value for the current page, a deviation may occur from the actual toner remaining amount value.

Therefore, according to a second exemplary embodiment of the present invention, the data processing procedure for a print job in the first exemplary embodiment is partly changed such that a toner remaining amount value coupled with the above-described setting information is calculated.

(Toner Remaining Amount Update Processing)

Figure 14:
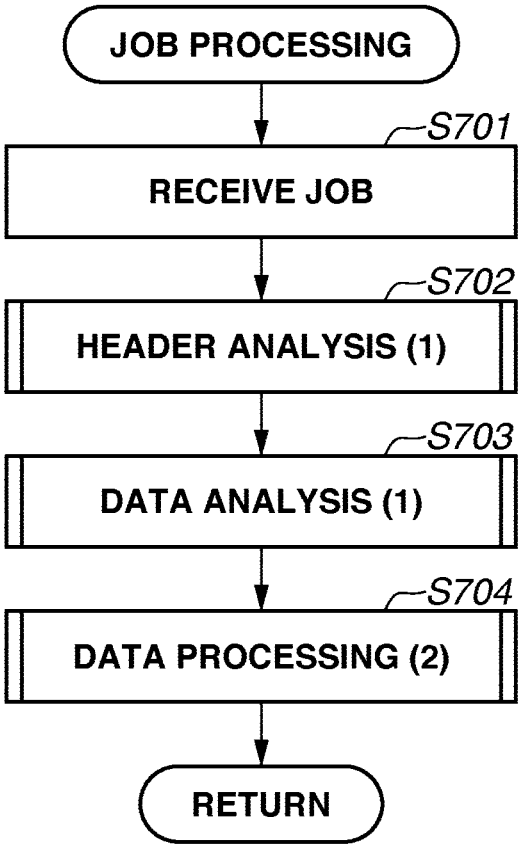
FIG. 14 is a flowchart illustrating toner remaining amount update processing according to a second exemplary embodiment of the present invention.

FIG. 14 is a flowchart illustrating the toner remaining amount update processing according to the second exemplary embodiment.

The flow in the flowchart of FIG. 14 is similar to the flow in the flowchart of FIG. 7 except for the content of data processing.

Figure 15:
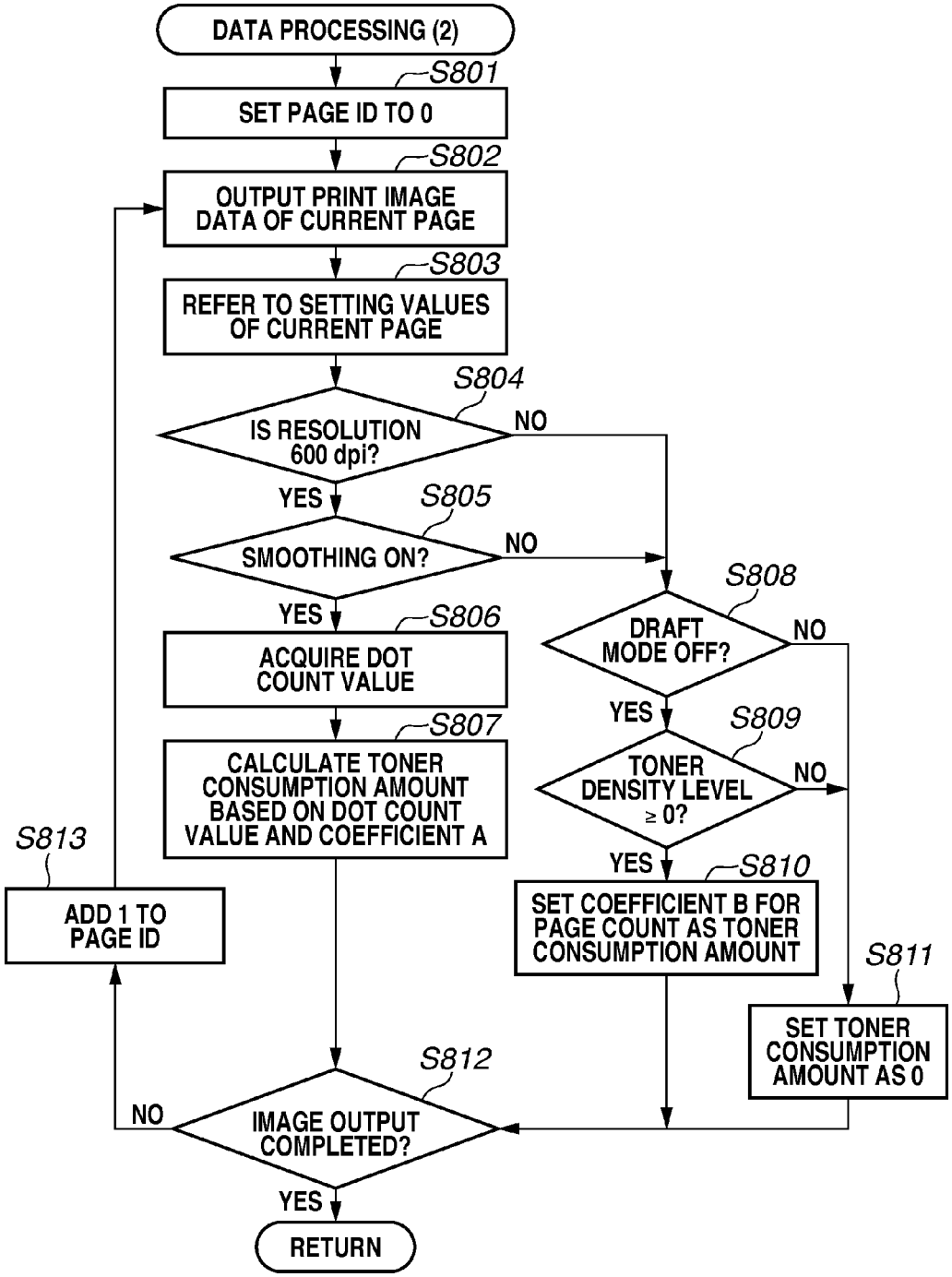
FIG. 15 is a flowchart illustrating a data processing procedure for the received print job according to the second exemplary embodiment.

FIG. 15 is a flowchart illustrating a data processing procedure for a received print job according to the second exemplary embodiment.

Since the data portion 702 of the print job data may include a plurality of pages, in step S801, the CPU 401 sets the page ID to "0" at the time of start of data processing and performs the following processing.

The CPU 401 enables the function of the dot counting unit 604. Next, the CPU 401 configures the settings for the DMA unit 601, the smoothing unit 602, and the PWM unit 603 based on the setting information of the current page stored in the RAM 403. Then, in step S802, the CPU 401 outputs print image data stored in the RAM 403 to the DMA unit 601.

In a case where the resolution is set to 600 dpi and the smoothing is set to ON, the print image data is output to the dot counting unit 604 and the PWM unit 603 via the DMA unit 601 and the smoothing unit 602 in the DMAC 407. When the print image data is input to the dot counting unit 604, the dot counting unit 604 counts the number of dots of the print image data. When the print image data is input to the PWM unit 603, the PWM unit 603 converts the print image data into the PWM format, and outputs the converted data to the print engine 303 via the engine I/F 406.

In a case where the resolution is set to other than 600 dpi or the smoothing is set to OFF, the print image data is output to the PWM unit 603 via the DMA unit 601 in the DMAC 407. Since the print image data is not input to the dot counting unit 604, the dot counting unit 604 does not count the number of dots of the print image data. When the print image data is input to the PWM unit 603, the PWM unit 603 converts the print image data into the PWM format, and outputs the converted data to the print engine 303 via the engine I/F 406.

In step S803, after outputting the print image data of the current page, the CPU 401 refers to the setting values 721 of the current page stored in the RAM 403.

If, as a result of referring to the setting values 721, the resolution is 600 dpi (YES in step S804), the processing proceeds to step S805. If the resolution is other than 600 dpi (NO in step S804), the processing proceeds to step S808.

If the smoothing is ON (YES in step S805), the processing proceeds to step S806. If the smoothing is other than ON (NO in step S805), the processing proceeds to step S808.

In step S806, the CPU 401 acquires the number of dots of the print image data of the current page from the dot counting unit 604.

In step S807, the CPU 401 calculates the toner consumption amount of the current page based on the acquired number of dots and a previously stored coefficient A, and stores the calculated toner consumption amount into the RAM 403.

If, as a result of referring to the setting values 721, the draft mode is OFF (YES in step S808), the processing proceeds to step S809. If the draft mode is other than OFF (NO in step S808), the processing proceeds to step S811.

If, as a result of referring to the setting values of the current page, the toner density level is equal to or higher than a standard value (YES in step S809), the processing proceeds to step S810. If the toner density level is lower than the standard value (NO in step S809), the processing proceeds to step S811.

In step S810, the CPU 401 sets a previously stored coefficient B as the toner consumption amount of the current page, and stores the set toner consumption amount into the RAM 403.

In step S811, the CPU 401 sets the toner consumption amount of the current page as "0", and stores the set toner consumption amount into the RAM 403.

If any print image data that has not yet been output is left in the print job data stored in the RAM 403 (NO in step S812), the processing proceeds to step S813. If no print image data that has not yet been output is left in the print job data stored in the RAM 403 (YES in step S812), the CPU 401 terminates data processing of the print job data.

In step S813, the CPU 401 increments the current page by one page, and the processing then returns to step S802.

((Description of Effect of Toner Remaining Amount Calculation in Second Exemplary Embodiment)

Figure 16A:
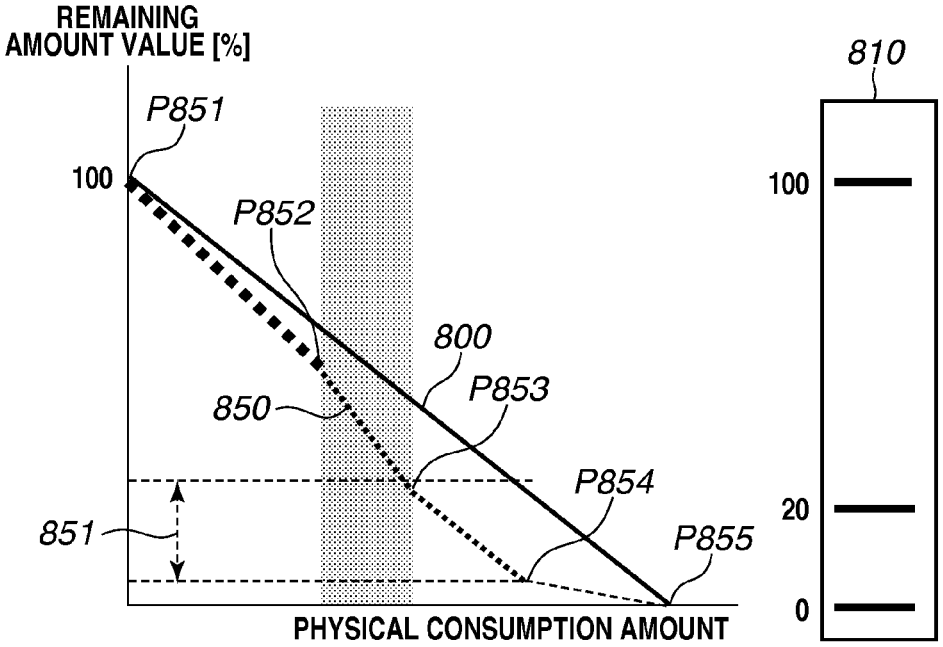
FIGS. 16A and 16B illustrate effects of toner remaining amount calculation according to the second exemplary embodiment.
Figure 16B:
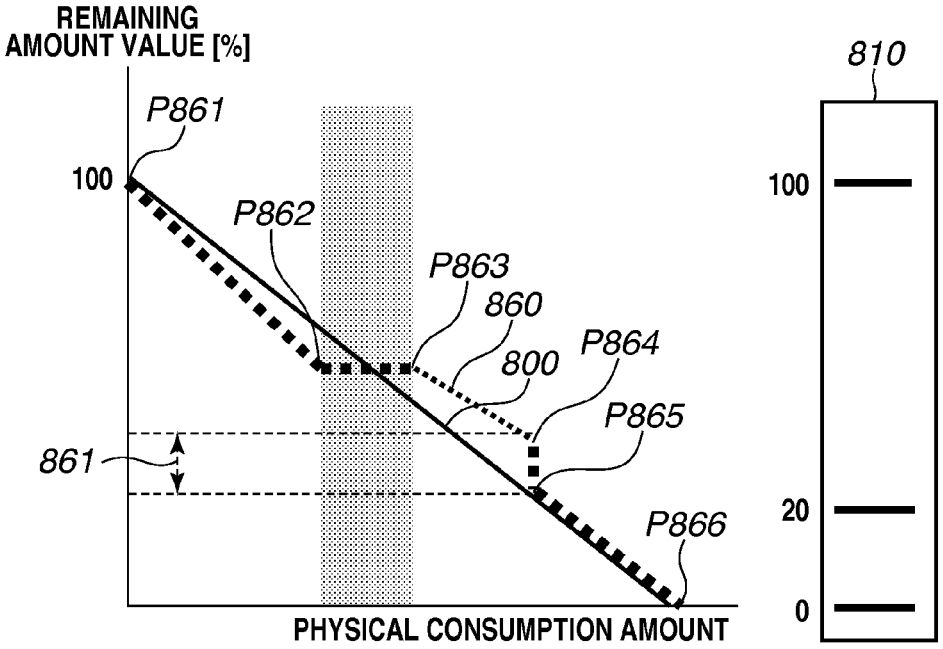

FIGS. 16A and 16B illustrate the effects of toner remaining amount calculation according to the second exemplary embodiment.

FIG. 16A illustrates an example of a transition of the toner remaining amount calculated value in a case where the toner remaining amount update processing in the first exemplary embodiment is performed when a print job in which printing is performed at low density is executed.

Line 800 indicates an ideal transition of the notification remaining amount value in a case where it is supposed that the same consumption amount as the physical consumption amount can be acquired.

A scale 810 indicates an example of points of the sensor remaining amount value (%) of which notice can be given from the print engine 303. In this example, the sensor remaining amount values of which notice can be given from the print engine 303 are 100%, 20%, and 0%, and 20% is set as a threshold value at low level.

Line 850 indicates a transition of the notification remaining amount value in a case where the toner remaining amount update processing in the first exemplary embodiment is performed.

Each of an interval from point P851 to P852 and an interval from point P853 to point P854 is an interval in which a print job in which the dot count value can be obtained is being executed. In this interval, the transition is plotted according to the toner remaining amount value calculated based on the dot count value obtained during execution of the print job.

An interval from point P852 to point P853 is an interval in which a print job in which the dot count value cannot be obtained is being executed. In this interval, since the coefficient B is uniformly allocated each time the page is incremented, the transition of the toner remaining amount value is plotted in the same manner as the line 830 illustrated in FIG. 13B.

However, since, in actuality, a print job in which printing is performed at low density is being executed, the line 850 actually deviates from the line 800, which indicates the ideal notification remaining amount value.

In an interval from point P854 to point P855, a difference from the ideal notification remaining amount value is revealed by the notification of the sensor remaining amount value of which notice is given from the print engine 303, so that the need to extremely moderately transition the toner remaining amount value occurs.

A double-headed arrow 851 indicates a difference between the toner remaining amount calculated value obtained in a case where the toner remaining amount update processing is performed according to the first exemplary embodiment and the ideal notification remaining amount value during execution of a print job in which printing is performed at low density when notice is given of the sensor remaining amount value from the print engine 303.

FIG. 16B illustrates a transition of the toner remaining amount calculated value in a case where the toner remaining amount update processing is performed according to the second exemplary embodiment.

Line 860 indicates a transition of the toner remaining amount calculated value in a case where the toner remaining amount update processing in the second exemplary embodiment is performed.

Each of an interval from point P861 to P862 and an interval from point P863 to point P864 is an interval in which a print job in which the dot count value can be obtained is being executed. In this interval, the transition of the toner remaining amount value is plotted in the same manner as the line 850 illustrated in FIG. 16A.

An interval from point P862 to point P863 is an interval in which a print job in which the dot count value cannot be obtained is being executed. In this interval, since it is found from the setting values of pages to be printed that the print job allows printing to be performed at low density, no addition is performed on the toner remaining amount value.

In an interval from point P864 to point P865, a moderate transition occurs in the toner remaining amount value due to the notification of the sensor remaining amount value of which notice can be given from the print engine 303.

A double-headed arrow 861 indicates a difference between the notification remaining amount value obtained in a case where the toner remaining amount update processing is performed according to the second exemplary embodiment and the ideal notification remaining amount value when notice is given of the sensor remaining amount value from the print engine 303.

The double-headed arrow 851 illustrated in FIG. 16A and the double-headed arrow 861 illustrated in FIG. 16B reveal that the difference between the notification remaining amount value obtained in a case where the toner remaining amount update processing is performed according to the second exemplary embodiment and the ideal notification remaining amount value is less than the difference between the notification remaining amount value obtained in a case where the toner remaining amount update processing is performed according to the first exemplary embodiment and the ideal notification remaining amount value.

As described above, the toner remaining amount update processing according to the second exemplary embodiment enables calculating a precise toner remaining amount value even when a print job in which printing is performed at low density is being executed.

In the above-described first exemplary embodiment, even in a case where there is a time until printing is started, like a reserve job, in the data processing of a print job, when the dot count function of hardware cannot be used, the coefficient B is uniformly calculated as the toner remaining amount value for the current page. In a case where there is a time until printing is started, it can be considered that the CPU 401 performs dot counting and uses a result of dot counting to calculate the toner remaining amount value. Therefore, according to a third exemplary embodiment of the present invention, the procedure for the toner remaining amount update processing in the first exemplary embodiment is partly changed to calculate the toner remaining amount value.

(Description of Processing Procedure for Reserve Job)

Figure 17:
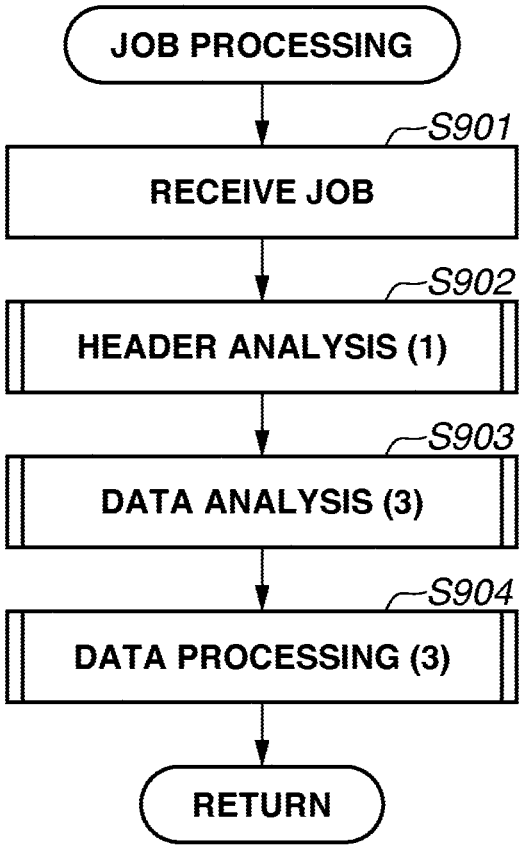
FIG. 17 is a flowchart illustrating a processing procedure for a reserve job according to a third exemplary embodiment of the present invention.

FIG. 17 is a flowchart illustrating a processing procedure for a reserve job of the received print data according to the third exemplary embodiment.

The flow in the flowchart of FIG. 17 is similar to the flow in the flowchart of FIG. 7 except for the contents of data analysis processing and data processing.

Figure 18:
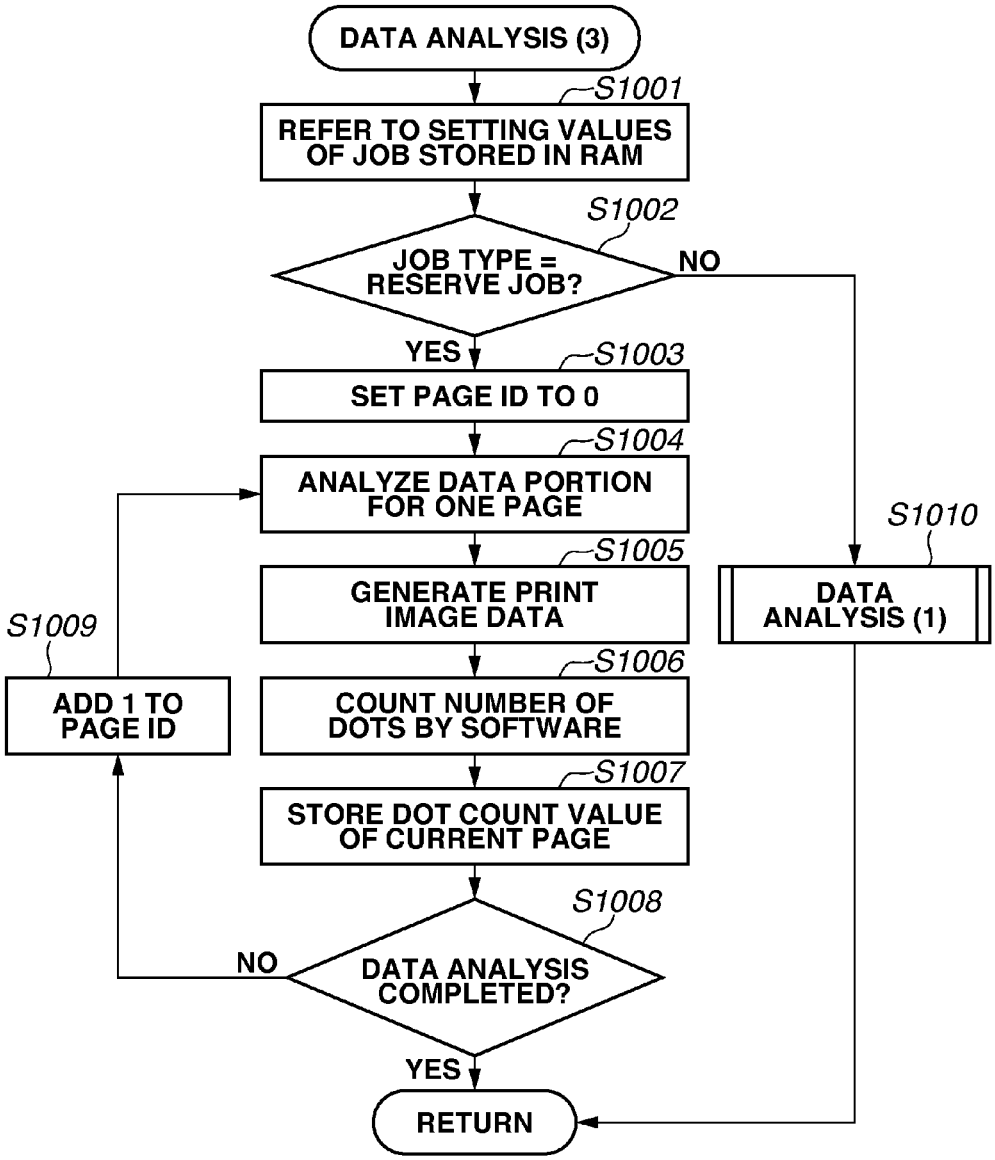
FIG. 18 is a flowchart illustrating a data analysis processing procedure for a reserve job of received print data according to the third exemplary embodiment.

FIG. 18 is a flowchart illustrating a data analysis processing procedure for a reserve job of the received print data according to the third exemplary embodiment.

In step S1001, the CPU 401 refers to setting values of a job type acquired from the header portion 701 stored in the RAM 403, and, in step S1002, the CPU 401 determines whether the job type is a reserve job.

If it is determined that the job type is the reserve job (YES in step S1002), the processing proceeds to step S1003.

If it is determined that the job type is other than the reserve job (NO in step S1002), then in step S1010, the CPU 401 performs the same data analysis processing as that illustrated in FIG. 9 in the first exemplary embodiment.

Since the data portion 702 of the print job data may include a plurality of pages, in step S1003, the CPU 401 sets the page ID to "0" at the time of start of data analysis and performs the following processing.

In step S1004, the CPU 401 performs PDL analysis for one page on the data portion 702 of the print job data stored in the RAM 403.

In step S1005, the CPU 401 causes the rendering unit 408 to generate print image data of the current page from intermediate data stored in the RAM 403, and stores the print image data into the RAM 403.

In step S1006, after generating the print image data of the current page, the CPU 401 counts the number of dots of the print image data.

In step S1007, after counting the number of dots of the print image data, the CPU 401 stores, into the RAM 403, the number of dots of the print image data in the structure of the setting values 721 such as that illustrated in FIG. 11C.

If any unanalyzed portion is present in the data portion 702 of the print job data stored in the RAM 403 (NO in step S1008), the processing proceeds to step S1009. If no unanalyzed portion is present in the data portion 702 of the print job data stored in the RAM 403 (YES in step S1008), the CPU 401 terminates the analysis of the print job data.

In step S1009, the CPU 401 increments the current page by one page, and the processing then returns to step S1004.

Figure 19:
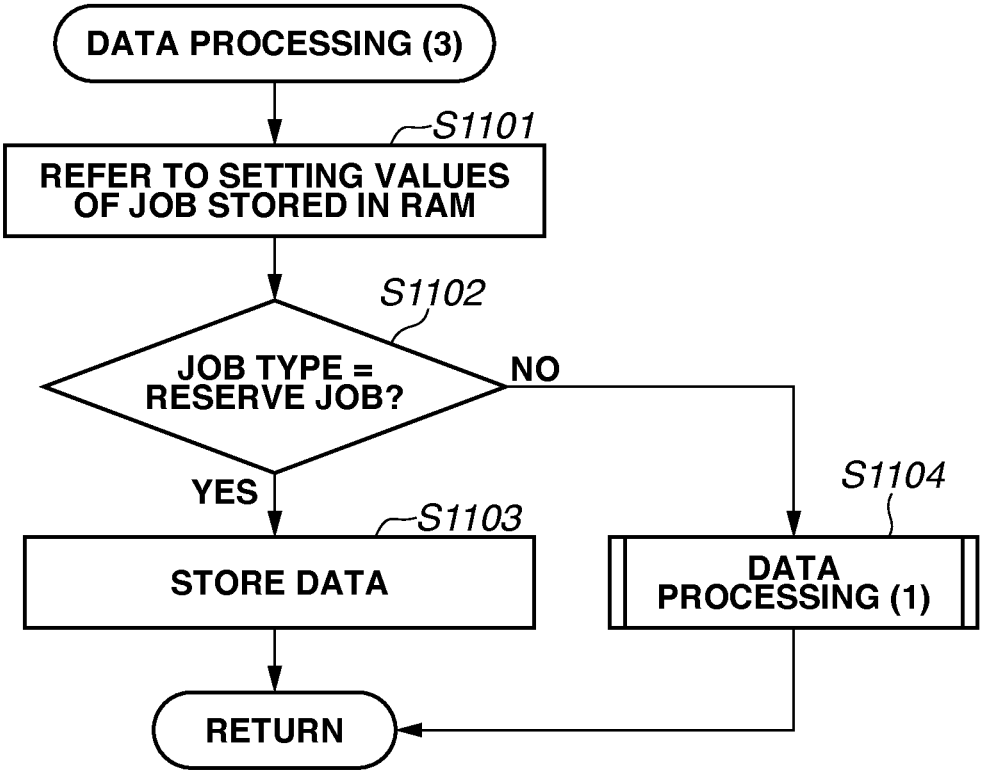
FIG. 19 is a flowchart illustrating a data processing procedure for the reserve job of received print data according to the third exemplary embodiment.

FIG. 19 is a flowchart illustrating a data processing procedure for a reserve job of the received print data according to the third exemplary embodiment.

In step S1101, the CPU 401 refers to setting values of a job type acquired from the header portion 701 stored in the RAM 403, and, in step S1102, the CPU 401 determines whether the job type is a reserve job.

If it is determined that the job type is other than the reserve job (NO in step S1102), then in step S1104, the CPU 401 performs the same data processing as that illustrated in FIG. 10 in the first exemplary embodiment.

If it is determined that the job type is the reserve job (YES in step S1102), then in step S1103, the CPU 401 stores, into removable media, the print job data and the setting values of each of the all pages, which are stored in the RAM 403.

(Description of Toner Remaining Amount Update Processing Procedure during Execution of Printing for Reserve Job)

Figure 20:
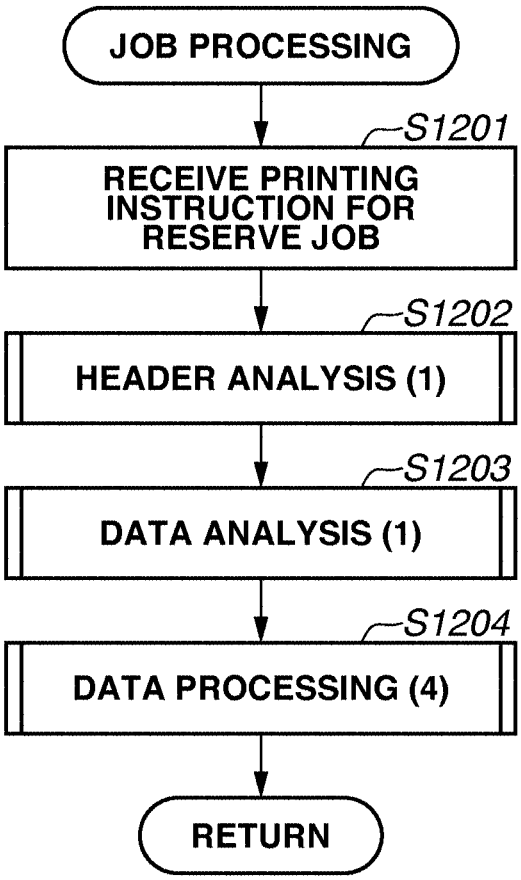
FIG. 20 is a flowchart illustrating a toner remaining amount update processing procedure during execution of printing for the reserve job according to the third exemplary embodiment.

FIG. 20 is a flowchart illustrating a toner remaining amount update processing procedure during execution of printing for a reserve job according to the third exemplary embodiment.

In step S1201, the CPU 401 receives a printing instruction for the reserve job, and then stores, into the RAM 403, the print job data and the setting values of all the pages, which are stored in the removable media.

Step S1202 and subsequent steps are similar to step S302 and subsequent steps in the toner remaining amount update processing procedure illustrated in FIG. 7 except for the content of data processing.

Figure 21:
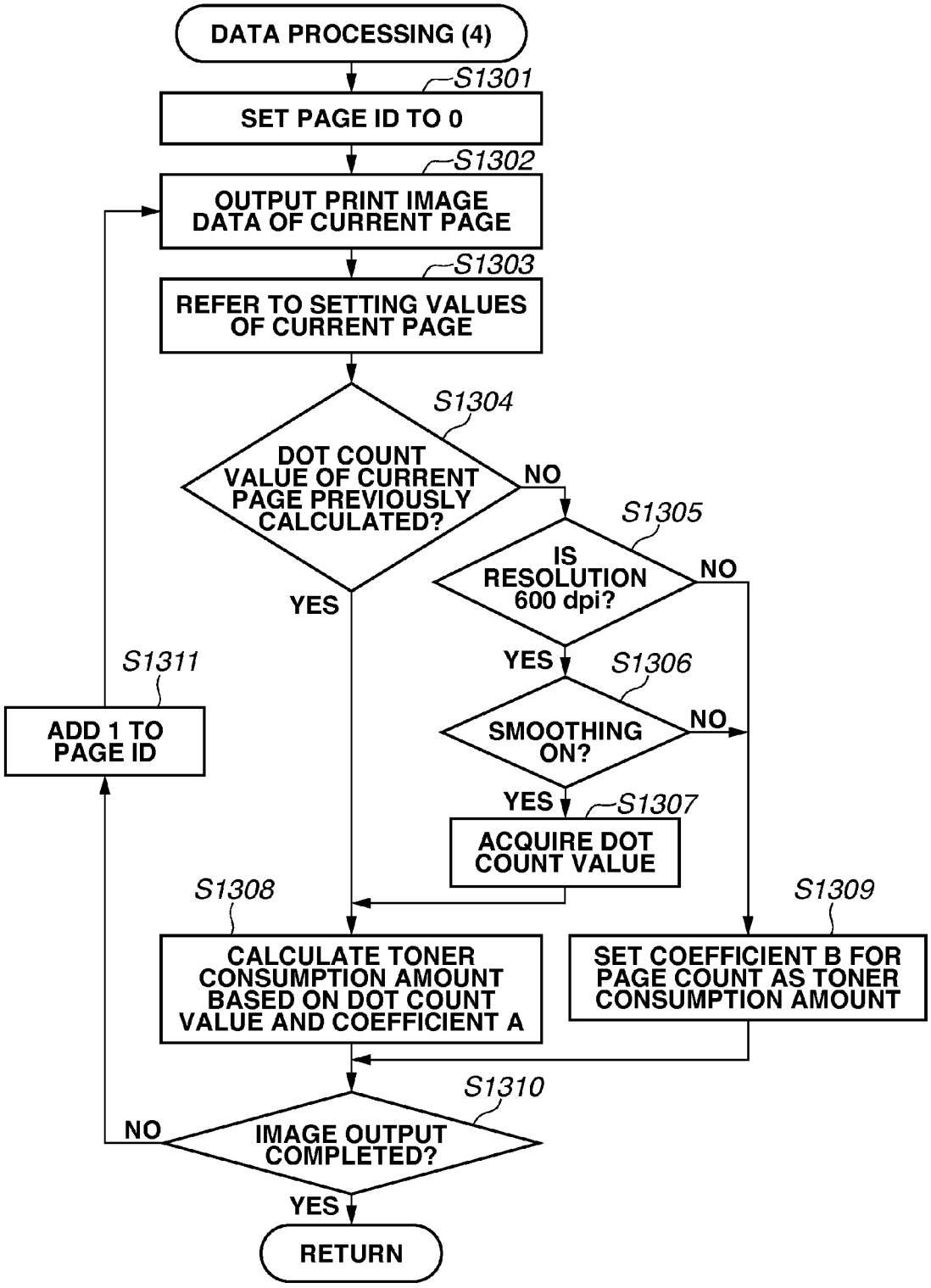
FIG. 21 is a flowchart illustrating a data processing procedure during execution of printing for the reserve job according to the third exemplary embodiment.

FIG. 21 is a flowchart illustrating a data processing procedure during execution of printing for the reserve job according to the third exemplary embodiment.

Since the data portion 702 of the print job data may include a plurality of pages, in step S1301, the CPU 401 sets the page ID to "0" at the time of start of data processing and performs the following processing.

The CPU 401 enables the function of the dot counting unit 604. Next, the CPU 401 configures the settings for the DMA unit 601, the smoothing unit 602, and the PWM unit 603 based on the setting information of the current page stored in the RAM 403. Then, in step S1302, the CPU 401 outputs print image data stored in the RAM 403 to the DMA unit 601.

In a case where the resolution is set to 600 dpi and the smoothing is set to ON, the print image data is output to the dot counting unit 604 and the PWM unit 603 via the DMA unit 601 and the smoothing unit 602 in the DMAC 407. When the print image data is input to the dot counting unit 604, the dot counting unit 604 counts the number of dots of the print image data. When the print image data is input to the PWM unit 603, the PWM unit 603 converts the print image data into the PWM format, and outputs the converted data to the print engine 303 via the engine I/F 406.

In a case where the resolution is set to other than 600 dpi or the smoothing is set to OFF, the print image data is output to the PWM unit 603 via the DMA unit 601 in the DMAC 407. Since the print image data is not input to the dot counting unit 604, the dot counting unit 604 does not count the number of dots of the print image data. When the print image data is input to the PWM unit 603, the PWM unit 603 converts the print image data into the PWM format, and outputs the converted data to the print engine 303 via the engine I/F 406.

In step S1303, after outputting the print image data of the current page, the CPU 401 refers to the setting values 721 of the current page stored in the RAM 403.

In step S1304, the CPU 401 checks whether the number of dots of the current page is previously stored among the setting values of the pages stored in the RAM 403. If the number of dots of the current page is previously stored (YES in step S1304), then in step S1308, the CPU 401 calculates the toner consumption amount of the current page based on the acquired number of dots and a previously stored coefficient A, and stores the calculated toner consumption amount into the RAM 403.

If the number of dots of the current page is not previously stored (NO in step S1304), the processing proceeds to step S1305.

If, as a result of referring to the setting values 721, the resolution is 600 dpi (YES in step S1305), the processing proceeds to step S1306. If the resolution is other than 600 dpi (NO in step S1305), the processing proceeds to step S1309.

If the smoothing is ON in the setting values of the current page (YES in step S1306), the processing proceeds to step S1307. If the smoothing is other than ON (NO in step S1306), the processing proceeds to step S1309.

In step S1307, the CPU 401 acquires the number of dots of the print image data of the current page from the dot counting unit 604.

In step S1308, the CPU 401 calculates the toner consumption amount of the current page based on the acquired number of dots and a previously stored coefficient A, and stores the calculated toner consumption amount into the RAM 403.

In step S1309, the CPU 401 sets a previously stored coefficient B as the toner consumption amount of the current page, and stores the set toner consumption amount into the RAM 403.

If any print image data that has not yet been output is left in the print job data stored in the RAM 403 (NO in step S1310), the processing proceeds to step S1311. If no print image data that has not yet been output is left in the print job data stored in the RAM 403 (YES in step S1310), the CPU 401 terminates data processing of the print job data.

In step S1311, the CPU 401 increments the current page by one page, and the processing then returns to step S1302.

(Description of Effect of Toner Remaining Amount Calculation in Third Exemplary Embodiment)

Figure 22:
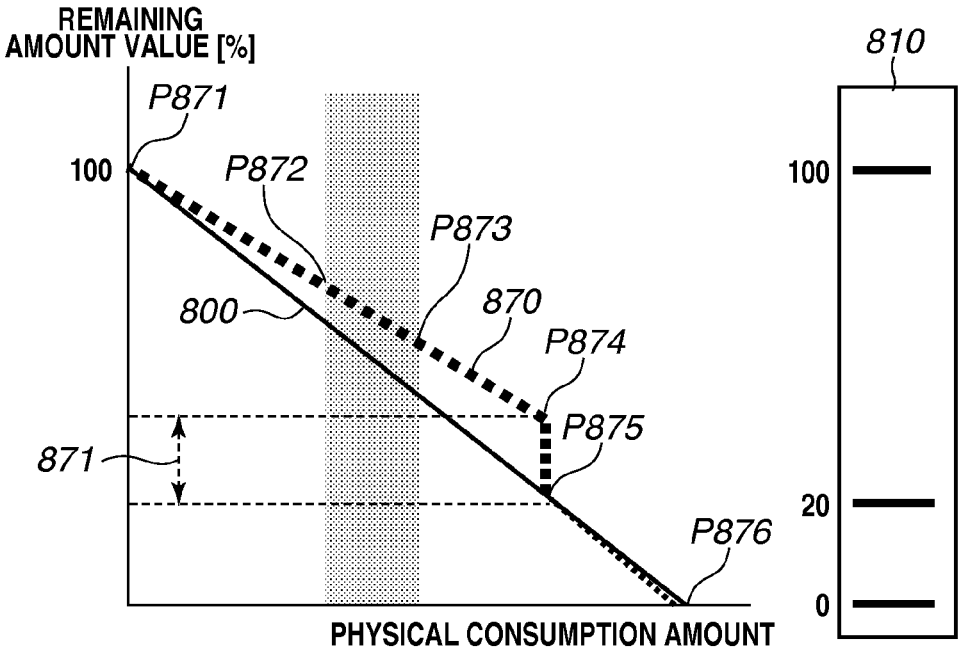
FIG. 22 illustrates an effect of toner remaining amount calculation according to the third exemplary embodiment.

FIG. 22 illustrates the effect of toner remaining amount calculation according to the third exemplary embodiment.

Line 800 indicates an ideal transition of the notification remaining amount value in a case where it is supposed that the same consumption amount as the physical consumption amount can be acquired.

A scale 810 indicates an example of points of the sensor remaining amount value (%) of which notice can be given from the print engine 303. In this example, the sensor remaining amount values of which notice can be given from the print engine 303 are 100%, 20%, and 0%, and 20% is set as a threshold value at low level.

Line 870 indicates a transition of the toner remaining amount calculated value in a case where the toner remaining amount update processing is performed according to the third exemplary embodiment.

Each of an interval from point P871 to P872 and an interval from point P873 to point P874 is an interval in which a print job in which the dot count value can be obtained is being executed. In this interval, the transition of the toner remaining amount value is plotted in the same manner as the line 820 illustrated in FIG. 13A.

In an interval from point P872 to point P873, the dot count value is obtained at the time of reception of the reserve job. Therefore, in this interval, the transition of the toner remaining amount value is plotted in the same manner as in the interval from point P871 to P872 and the interval from P873 to P874.

In an interval from point P874 to point P875, a moderate transition occurs in the toner remaining amount value due to the notification of the sensor remaining amount value of which notice can be given from the print engine 303.

A double-headed arrow 871 indicates a difference between the notification remaining amount value obtained in a case where the toner remaining amount update processing is performed according to the third exemplary embodiment and the ideal notification remaining amount value when notice is given of the sensor remaining amount value from the print engine 303.

The double-headed arrow 841 illustrated in FIG. 13C and the double-headed arrow 871 illustrated in FIG. 22 reveal that the difference between the notification remaining amount value obtained in a case where the toner remaining amount update processing is performed according to the third exemplary embodiment and the ideal notification remaining amount value is less than a difference between the notification remaining amount value and the ideal notification remaining amount value according to the first exemplary embodiment.

As described above, the toner remaining amount update processing according to the third exemplary embodiment enables calculating a precise toner remaining amount value at the time of execution of printing for a reserve job.

In the above-described first exemplary embodiment, during the data analysis processing of a print job, even in a case where a considerable amount of print image data that has been analyzed but has not yet been printed is left, a certain amount of time can be secured until printing is started, as in a reserve job. In this case also, it can be considered that the CPU 401 performs dot counting and uses a result of dot counting to calculate the toner remaining amount value. Therefore, according to a fourth exemplary embodiment of the present invention, the procedure for the toner remaining amount update processing in the first exemplary embodiment is partly changed to calculate the toner remaining amount value.

(Description of Processing Procedure for Print Job)

Figure 23:
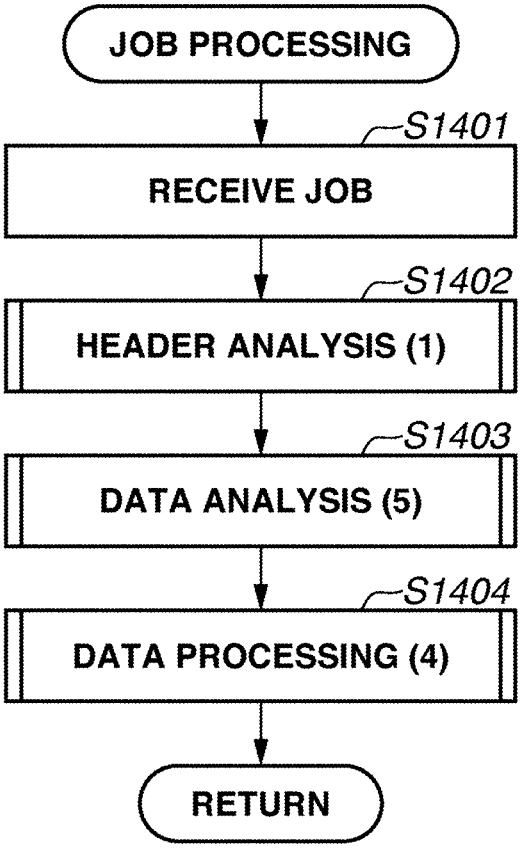
FIG. 23 illustrates an effect of toner remaining amount update processing according to a fourth exemplary embodiment of the present invention.

FIG. 23 is a flowchart illustrating a processing procedure for a received print job according to the fourth exemplary embodiment.

The flow in the flowchart of FIG. 23 is similar to the flow in the flowchart of FIG. 7 except for the contents of data analysis processing and data processing. The content of data processing is similar to the flow in the data processing procedure at the time of execution of printing for the reserve job described in the third exemplary embodiment.

Figure 24:
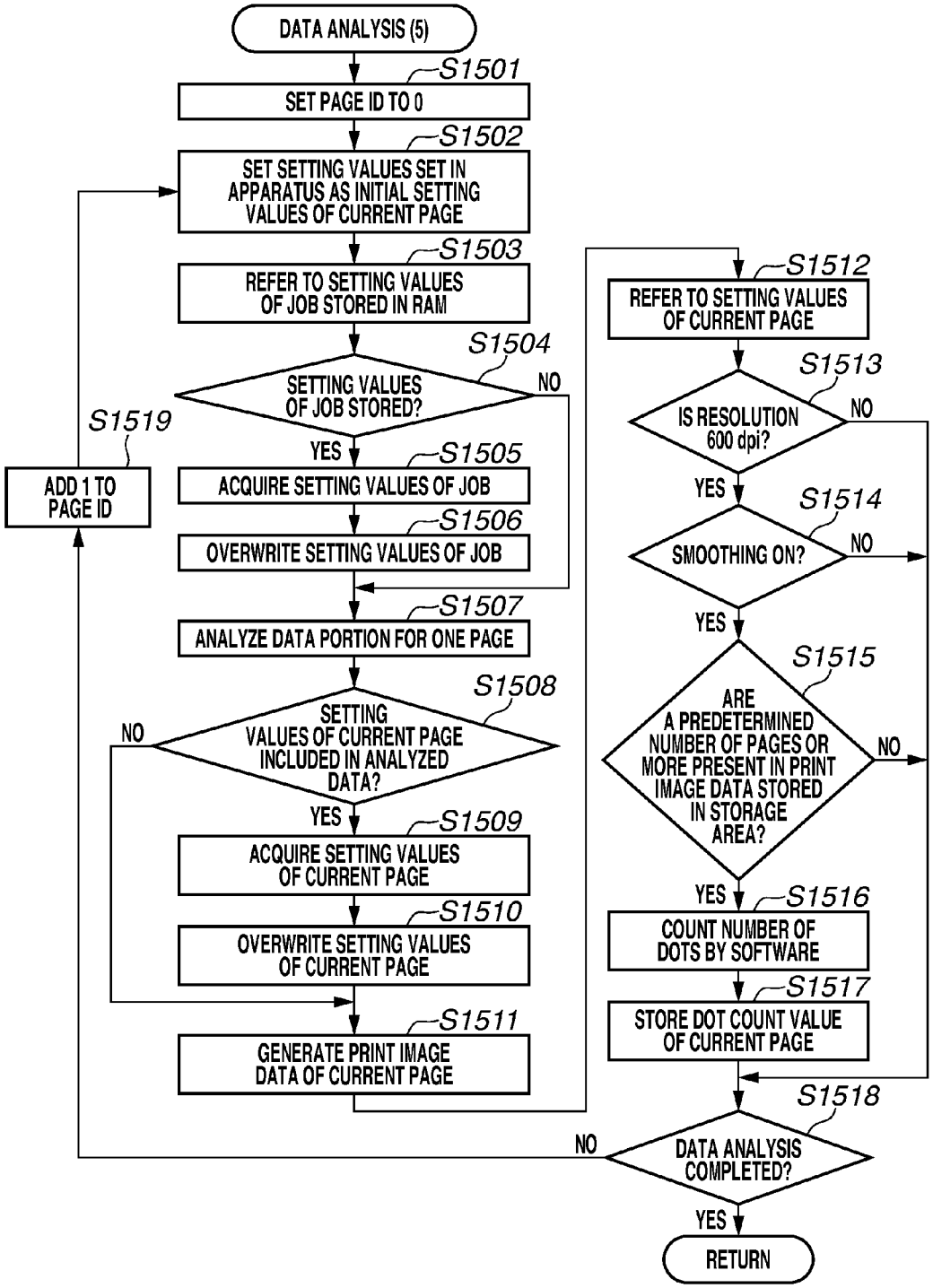
FIG. 24 is a flowchart illustrating a data analysis processing procedure for a received print job according to the fourth exemplary embodiment.

FIG. 24 is a flowchart illustrating a data analysis processing procedure for a received print job according to the fourth exemplary embodiment.

Since the data portion 702 of the print job data may include a plurality of pages, in step S1501, the CPU 401 sets the page ID to "0" at the time of start of data analysis and performs the following processing.

In step S1502, the CPU 401 stores, into the RAM 403, the setting values including the resolution and smoothing of the image forming apparatus 102, which is stored in the EEPROM 410, as setting values of the current page of the print job data.

The above-mentioned setting values 721 of the current page are stored in the RAM 403 in association with the job ID 722 for identifying the print job and the page ID 723, as illustrated in FIG. 11C.

In step S1503, the CPU 401 refers to the setting values 711 of the job stored in the RAM 403.

If the setting values 711 of the job corresponding to the job ID subjected to data analysis are stored in the RAM 403 (YES in step S1504), then in step S1505, the CPU 401 acquires the setting values 711.

In step S1506, the CPU 401 overwrites the setting values 721 of the current page of the print job data stored in the RAM 403 with the acquired setting values 711.

In step S1507, the CPU 401 performs PDL analysis for one page on the data portion 702 of the print job data stored in the RAM 403.

If, as a result of analysis, the setting values of the current page are included in the data portion 702 (YES in step S1508), then in step S1509, the CPU 401 acquires the setting values, and, in step S1510, the CPU 401 overwrites the setting values 721 of the current page of the print job data stored in the RAM 403 with the acquired setting values.

In step S1511, the CPU 401 causes the rendering unit 408 to generate print image data of the current page from the intermediate data stored in the RAM 403, and stores the print image data into the RAM 403.

In step S1512, after generating the print image data, the CPU 401 refers to the setting values 721 of the current page stored in the RAM 403.

If, as a result of referring to the setting values 721, the resolution is 600 dpi (YES in step S1513), the processing proceeds to step S1514. If the resolution is other than 600 dpi (NO in step S1513), the processing proceeds to step S1518.

If the smoothing is ON in the setting values of the current page (YES in step S1514), the processing proceeds to step S1515. If the smoothing is other than ON (NO in step S1514), the processing proceeds to step S1518.

In step S1515, the CPU 401 checks for print image data, stored in the RAM 403, that has not yet been output. If pages the number of which is less than a predetermined number are present in the print image data that has not yet been output (NO in step S1515), the processing proceeds to step S1518. If pages the number of which is the predetermined number or more are present in the print image data that has not yet been output (YES in step S1515), the processing proceeds to step S1516.

In step S1516, the CPU 401 counts the number of dots of the print image data of the current page.

In step S1517, after counting the number of dots of the print image data, the CPU 401 stores the number of dots of the print image data into the RAM 403.

If any unanalyzed portion is present in the data portion 702 of the print job data stored in the RAM 403 (NO in step S1518), the processing proceeds to step S1519. If no unanalyzed portion is present in the data portion 702 of the print job data stored in the RAM 403 (YES in step S1518), the CPU 401 terminates the analysis of the print job data.

In step S1519, the CPU 401 increments the current page by one page, and the processing then returns to step S1502.

(Description of Effect of Toner Remaining Amount Calculation in Fourth Exemplary Embodiment)

Figure 25:
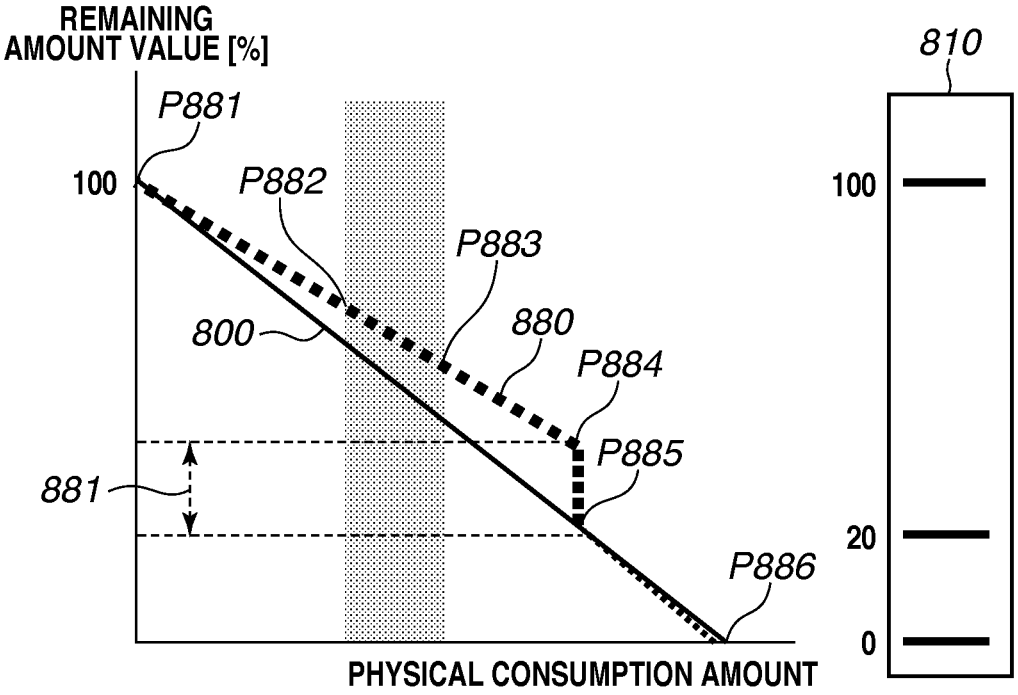
FIG. 25 illustrates an effect of toner remaining amount calculation according to the fourth exemplary embodiment.

FIG. 25 illustrates the effect of toner remaining amount calculation according to the fourth exemplary embodiment.

Line 800 indicates an ideal transition of the notification remaining amount value in a case where it is supposed that the same consumption amount as the physical consumption amount can be acquired.

A scale 810 indicates an example of points of the sensor remaining amount value (%) of which notice can be given from the print engine 303. In this example, the sensor remaining amount values of which notice can be given from the print engine 303 are 100%, 20%, and 0%, and 20% is set as a threshold value at low level.

Line 880 indicates a transition of the toner remaining amount calculated value in a case where the toner remaining amount update processing is performed according to the fourth exemplary embodiment.

Each of an interval from point P881 to P882 and an interval from point P883 to point P884 is an interval in which a print job in which the dot count value can be obtained is being executed. In this interval, the transition of the toner remaining amount value is plotted in the same manner as the line 820 illustrated in FIG. 13A.

In an interval from point P882 to point P883, in a case where the data analysis processing precedes the data processing by a predetermined number of pages or more, the dot count value is acquired during the data analysis processing. Therefore, in this interval, the transition of the toner remaining amount value is plotted in the same manner as in the interval from point P881 to P882 and the interval from P883 to P884.

In an interval from point P884 to point P885, a moderate transition occurs in the toner remaining amount value due to the notification of the sensor remaining amount value of which notice can be given from the print engine 303.

A double-headed arrow 881 indicates a difference between the notification remaining amount value obtained in a case where the toner remaining amount update processing is performed according to the fourth exemplary embodiment and the ideal notification remaining amount value when notice is given of the sensor remaining amount value from the print engine 303.

The double-headed arrow 841 illustrated in FIG. 13C and the double-headed arrow 881 illustrated in FIG. 25 reveal that the difference between the notification remaining amount value obtained in a case where the toner remaining amount update processing is performed according to the fourth exemplary embodiment and the ideal notification remaining amount value is less than a difference between the notification remaining amount value and the ideal notification remaining amount value according to the first exemplary embodiment.

As described above, the toner remaining amount update processing according to the fourth exemplary embodiment enables calculating a precise toner remaining amount value in a case where the data analysis processing precedes the data processing by a predetermined number of pages or more.

In this way, the fourth exemplary embodiment not only enables counting the number of dots but also controls calculation of a toner remaining amount value based on a printing condition.

In the above-described exemplary embodiments, the resolution or the setting value of smoothing is provided as an example of a case where the dot count function by hardware cannot be used. However, this is not restrictive.

Furthermore, in the above-described exemplary embodiments, the draft mode or the setting of toner density is provided as an example of a setting method in which printing is performed at a density lower than usual. However, this is not restrictive.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-179996 filed Aug. 30, 2013, which is hereby incorporated by reference herein in its entirety.

What is claimed is:

1. An image forming apparatus comprising:

a reception unit configured to receive print data;

a printing unit configured to perform print processing based on the print data; and a determination unit configured to determine a consumption amount of toner used to perform the print processing, wherein the determination unit selects, based on a type of the print data, any of first processing for determining the consumption amount of toner based on a dot count and second processing for determining the consumption amount of toner based on a number of print pages.

2. The image forming apparatus according to claim 1, further comprising:

an identification unit configured to identify a remaining amount of toner based on the consumption amount determined by the determination unit; and a display unit configured to display the remaining amount of toner identified by the identification unit.

3. A calculation method for calculating a consumption amount of toner, the calculation method comprising:

receiving print data;

performing print processing based on the print data; and determining a consumption amount of toner used to perform the print processing, wherein in the determination step, based on a type of the print data, any of first processing for determining the consumption amount of toner based on a dot count and second processing for determining the consumption amount of toner based on a number of print pages, is selected.

4. A computer-readable storage medium storing computer-executable instructions that, when read and executed by a computer, cause the computer to perform a calculation method for calculating a consumption amount of toner, the calculation method comprising:

receiving print data;

performing print processing based on the print data; and determining a consumption amount of toner used to perform the print processing, wherein in the determination step, based on a type of the print data, any of first processing for determining the consumption amount of toner based on a dot count and second processing for determining the consumption amount of toner based on a number of print pages, is selected.

5. An image forming apparatus comprising:

a reception unit configured to receive print data;

a printing unit configured to perform print processing based on the print data; and a determination unit configured to determine a consumption amount of toner used to perform the print processing, wherein in a case where a resolution of the print data is a predetermined resolution and setting of smoothing is on, the determination unit determines the consumption amount of toner based on a dot count and wherein in a case where the resolution of the print data is not the predetermined resolution or the setting of smoothing is off, the determination unit determines the consumption amount of toner based on a number of print pages.

6. The image forming apparatus according to claim 5, further comprising:

an identification unit configured to identify a remaining amount of toner based on the consumption amount determined by the determination unit; and a display unit configured to display the remaining amount of toner identified by the identification unit.

7. The image forming apparatus according to claim 5, wherein the predetermined resolution is 600 dpi.

8. An image forming method comprising:

receiving print data;

performing print processing based on the print data; and determining a consumption amount of toner used to perform the print processing, wherein in a case where a resolution of the print data is a predetermined resolution and setting of smoothing is on, determining the consumption amount of toner based on a dot count, and wherein in a case where the resolution of the print data is not the predetermined resolution or the setting of smoothing is off, determining the consumption amount of toner based on a number of print pages.

9. A computer-readable storage medium storing computer-executable instructions that, when read and executed by a computer, cause the computer to perform an image forming method comprising:

receiving print data;

performing print processing based on the print data; and determining a consumption amount of toner used to perform the print processing, wherein in a case where a resolution of the print data is a predetermined resolution and setting of smoothing is on, determining the consumption amount of toner based on a dot count, and wherein in a case where the resolution of the print data is not the predetermined resolution or the setting of smoothing is off, determining the consumption amount of toner based on a number of print pages.

* * * * *